US011339488B2

(12) United States Patent
Ua Cearnaigh

(10) Patent No.: US 11,339,488 B2
(45) Date of Patent: May 24, 2022

(54) SYSTEM AND METHOD FOR CONTROLLING A MULTI-STATE ELECTROCHEMICAL CELL

(71) Applicant: Achínibahjeechin Intellectual Property, LLC, Lubbock, TX (US)

(72) Inventor: Deóis Chiaráin Mac Séamuis Ua Cearnaigh, San Marcos, TX (US)

(73) Assignee: ACHÍNIBAHJEECHIN INTELLECTUAL PROPERTY, LLC, Lubbock, TX (US)

( * ) Notice: Subject to any disclaimer, the term of this patent is extended or adjusted under 35 U.S.C. 154(b) by 691 days.

(21) Appl. No.: 16/279,751

(22) Filed: Feb. 19, 2019

(65) Prior Publication Data

US 2020/0263310 A1 Aug. 20, 2020

(51) Int. Cl.

| | |
|---|---|
| ***C25B 15/02*** | (2021.01) |
| ***C25B 1/16*** | (2006.01) |
| ***C25B 15/027*** | (2021.01) |
| ***C25B 1/26*** | (2006.01) |
| ***C25B 1/34*** | (2006.01) |
| ***C25B 1/46*** | (2006.01) |
| ***C25C 7/06*** | (2006.01) |

(52) U.S. Cl.

CPC ..... *C25B 15/02* (2013.01); *C25B 1/16* (2013.01); *C25B 1/26* (2013.01); *C25B 1/34* (2013.01); *C25B 1/46* (2013.01); *C25B 15/027* (2021.01); *C25C 7/06* (2013.01)

(58) Field of Classification Search

CPC .... C25B 1/16; C25B 1/34; C25B 1/26; C25B 15/02; C25B 15/027; C25B 1/46

See application file for complete search history.

(56) References Cited

U.S. PATENT DOCUMENTS

| | | | | |
|---|---|---|---|---|
| 2004/0137291 | A1 | 7/2004 | Smedley et al. | |
| 2010/0261085 | A1 | 10/2010 | Gu et al. | |
| 2011/0200899 | A1 | 8/2011 | Mata et al. | |
| 2015/0329980 | A1* | 11/2015 | Pedersen | C25B 1/04 205/337 |

(Continued)

OTHER PUBLICATIONS

International Search Report and Written Opinion, Application No. PCT/US2020/018331, dated May 27, 2020, 12 pages.

*Primary Examiner* — Nicholas A Smith

(74) *Attorney, Agent, or Firm* — Baker Botts L.L.P.

(57) ABSTRACT

A system for controlling an electrochemical production process includes a variable controllable power circuit and an electrolytic cell. The cell includes two electrodes and operates in different states dependent on the potential difference across the electrodes. The system includes a power circuit controller that causes the power circuit to apply a given potential difference across the electrodes to initiate operation of the cell in the one of multiple possible states associated with the given potential difference. The possible states include a production state associated with a first non-zero potential difference in which a product of interest is produced, and an idle state associated with a second non-zero potential difference in which the product of interest is not produced. A monitoring and control subsystem maintains a predefined set of production process conditions, including a predefined operating temperature range, while the cell operates in both the production state and the idle state.

20 Claims, 11 Drawing Sheets

(56) References Cited

U.S. PATENT DOCUMENTS

2016/0194769 A1* 7/2016 Arai ..... C25B 15/08
205/351
2016/0312369 A1 10/2016 Moussallem et al.

* cited by examiner

SYSTEM AND METHOD FOR CONTROLLING A MULTI-STATE ELECTROCHEMICAL CELL

BACKGROUND

Field of the Disclosure

The present disclosure relates to electrochemical production processes and, more specifically, to systems and methods for controlling an electrochemical production process in an electrolytic cell that operates in both a production state and an idle state under a predefined set of production process conditions.

Description of the Related Art

Electrolysis is used in many industries for the production of various metals and non-metals. For example, sodium, chlorine, magnesium, fluorine, and aluminum are produced commercially using electrolysis. In existing electrolytic cells, production process conditions, such as temperature, pressure, pH, or active species concentration, change as the potential difference between the electrodes decreases. With these existing electrolytic cells, there is a limited range of current and voltage values over which the cells produce the product of interest. For example, if the current in these electrolytic cells falls below a critical point, the ionic gradient of the electrolytic cell decreases, eventually causing the charging layer to be disrupted and, ultimately, to collapse, causing irreversible damage to the cell.

SUMMARY

In one aspect, a disclosed system includes a variable controllable power circuit, and an electrolytic cell coupled to the variable controllable power circuit and including an anode and a cathode. The electrolytic cell is configured to operate in different ones of multiple operating states at respective different times dependent on a potential difference between the anode and the cathode. The system further includes a power circuit controller that causes the variable controllable power circuit to apply a given potential difference across the anode and the cathode to initiate operation of the electrolytic cell in a particular one of the multiple operating states associated with the given potential difference. The multiple operating states include a production state associated with a first non-zero potential difference in which a product of interest is produced by the electrolytic cell, and an idle state associated with a second non-zero potential difference in which the product of interest is not produced by the electrolytic cell.

In any of the disclosed embodiments, the system may further include a monitoring and control subsystem configured to maintain a predefined set of production process conditions for the electrolytic cell while the electrolytic cell is operating in the production state and while the electrolytic cell is operating in the idle state. The predefined set of production process conditions may include a predefined operating temperature range.

In another aspect, a disclosed method includes configuring a variable controllable power circuit to apply a first non-zero potential difference across an anode and a cathode of an electrolytic cell to initiate operation of the electrolytic cell in a production state associated with the first non-zero potential difference in which a product of interest is produced by state electrolytic cell, beginning production of the produce of interest, and subsequent to beginning production of the product of interest, configuring the variable controllable power circuit to apply a second non-zero potential difference across the anode and the cathode of the electrolytic cell to initiate operation of the electrolytic cell in an idle state associated with the second non-zero potential difference in which the product of interest is not produced by the electrolytic cell.

In any of the disclosed embodiments, the method may further include, prior to application of the first non-zero potential difference across the anode and the cathode of the electrolytic cell, configuring the electrolytic cell to operate under a predefined set of production process conditions comprising a predefined operating temperature range. The method may also include maintaining the predefined set of production process conditions while the electrolytic cell is operating in the production state and maintaining the predefined set of production process conditions while the electrolytic cell is operating in the idle state.

In any of the disclosed embodiments, the electrolytic cell may include two or more tanks, each comprising a feedstock for an electrochemical process, and an ionic conduction path between the tanks.

In any of the disclosed embodiments, the electrolytic cell may be one of a plurality of multi-state electrolytic cells each comprising a respective anode and a respective cathode. The potential differences across the anodes and cathodes in the multi-state electrolytic cells may be collectively controllable.

In any of the disclosed embodiments, the electrolytic cell may be one of a plurality of multi-state electrolytic cells each comprising a respective anode and a respective cathode. Respective potential differences across the anodes and cathodes in each of the multi-state electrolytic cells may be individually controllable.

In any of the disclosed embodiments, the variable power control circuit may receive power from a non-schedulable power source.

In any of the disclosed embodiments, the variable power control circuit may include a polarization rectifier that imposes a lower bound on the given potential difference applied across the anode and the cathode by the variable controllable power circuit.

In any of the disclosed embodiments, the variable power control circuit may be controllable to select a power source for applying the given potential difference across the anode and the cathode from among two or more power sources.

In any of the disclosed embodiments, the monitoring and control subsystem may receive data from a sensor representing a measurement of a current condition in the multi-state electrolytic cell.

In any of the disclosed embodiments, maintaining the predefined set of production process conditions may include activating a heating or cooling element to return a temperature of the multi-static electrolytic cell to a value within a predefined temperature range in response to receiving an indication that the temperature of the multi-static electrolytic cell is outside the predefined temperature range.

In any of the disclosed embodiments, maintaining the predefined set of production process conditions may include applying or reducing back pressure on a head gas within the multi-state electrolytic cell to return a head gas pressure within the multi-static electrolytic cell to a value within a predefined pressure range in response to receiving an indication that the head gas pressure within the multi-static electrolytic cell is outside the predefined pressure range.

In any of the disclosed embodiments, maintaining the predefined set of production process conditions may include increasing or reducing a concentration of an active species within a feedstock of the multi-state electrolytic cell to return the active species concentration within the feedstock to a value within a predefined concentration range in response to receiving an indication that the active species concentration within the feedstock is outside the predefined concentration range.

In any of the disclosed embodiments, maintaining the predefined set of production process conditions may include adding an acid or base to an electrolyte to return the pH of the multi-static electrolytic cell to a value within a predefined pH range in response to receiving an indication that the pH of the multi-static electrolytic cell is outside the predefined temperature range.

In any of the disclosed embodiments, the electrolytic cell may include a recirculation loop through which an output of the electrochemical process is returned to the multi-state electrolytic cell as an input.

In any of the disclosed embodiments, the electrolytic cell may be configured to produce a second product of interest while the electrolytic cell operates in the production state.

In any of the disclosed embodiments, the production state may be one of a plurality of production states in which the multi-state electrolytic cell is configured to operate and the rate at which the multi-state electrolytic cell produces the product of interest or the rate at which the multi-state electrolytic cell consumes input resources may be dependent on the one of the production states in which the multi-state electrolytic cell is operating.

In any of the disclosed embodiments, the production state may be one of a plurality of production states in which the multi-state electrolytic cell is configured to operate, the electrolytic cell may be configured to produce a plurality of products of interest, and the relative amounts of the plurality of products of interest produced by the multi-state electrolytic cell may be dependent on the one of the production states in which the multi-state electrolytic cell is operating.

In any of the disclosed embodiments, the product of interest may be or include a gas.

In any of the disclosed embodiments, the product of interest may be, include, or become a solid.

In any of the disclosed embodiments, the product of interest may be, include, or become a liquid.

In any of the disclosed embodiments, the product of interest may be or include a purified or modified feedstock.

In any of the disclosed embodiments, the electrolytic cell may be configured to produce the product of interest using electrolysis of an aqueous solution.

In any of the disclosed embodiments, the electrolytic cell may be configured to produce the product of interest using electrolysis of a nonaqueous solution.

In any of the disclosed embodiments, the electrolytic cell may be configured for a chlor-alkali production process and, when operating in the production state, may produce chlorine, an alkali, and hydrogen as products of interest.

In any of the disclosed embodiments, the electrolytic cell may be configured to extract a metal as the product of interest using electrolysis of a molten salt.

In any of the disclosed embodiments, the electrolytic cell may be configured to produce the product of interest using an electroplating process.

BRIEF DESCRIPTION OF THE DRAWINGS

For a more complete understanding of the present invention and its features and advantages, reference is now made to the following description, taken in conjunction with the accompanying drawings, in which.

DESCRIPTION OF PARTICULAR EMBODIMENT(S)

Figure 1:
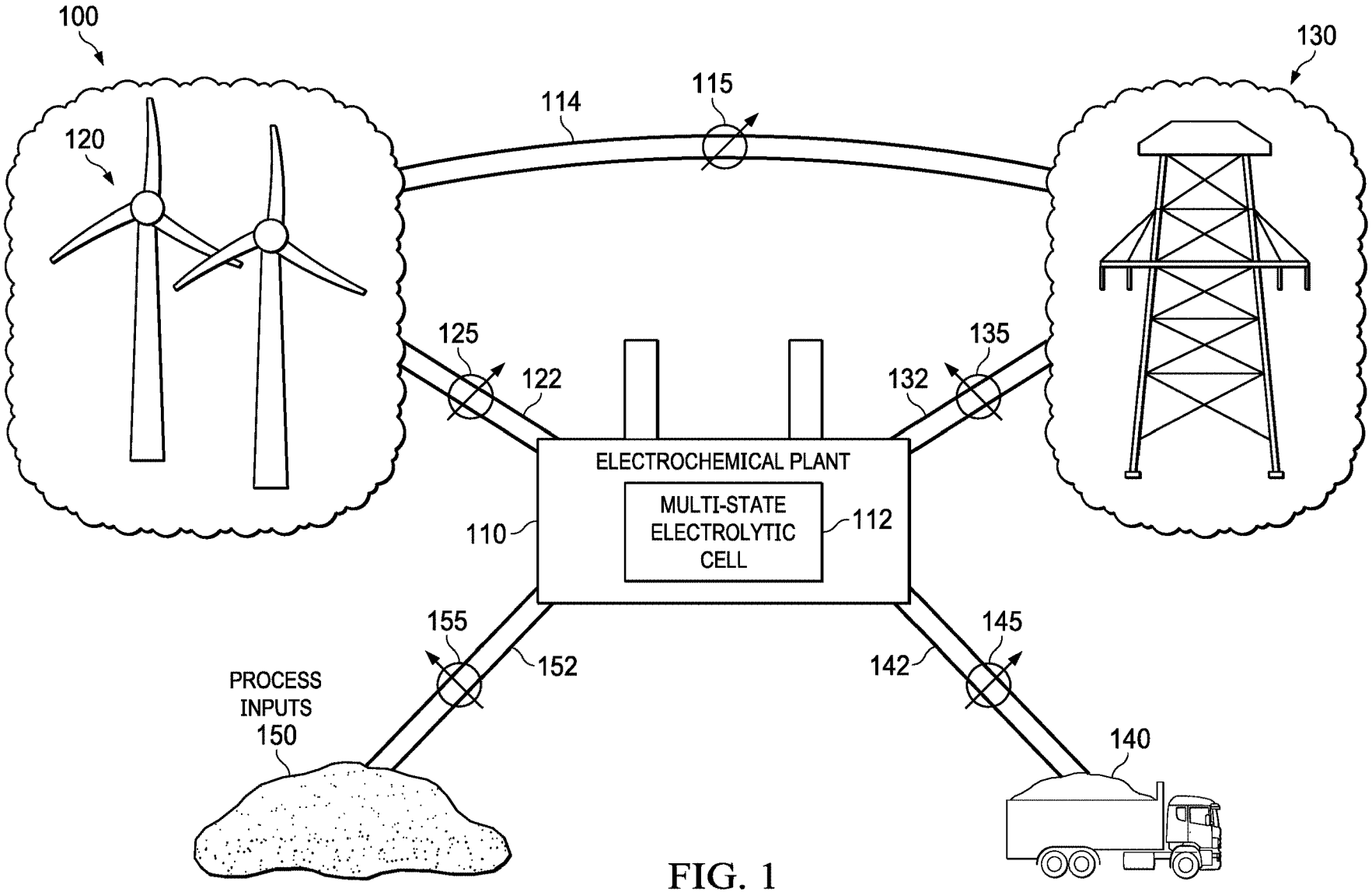
FIG. 1 is a block diagram illustrating selected elements of a system for producing a product of interest using a multi-state electrolytic cell, in accordance with some embodiments of the present disclosure.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Electrochemistry is used in many industries for the production of various metals and non-metals including sodium and potassium hydroxide, chlorine, fluorine, sulfuric acid, magnesium, and aluminum. In one example, an electrolytic cell may be configured to produce a product of interest using electrolysis of an aqueous solution, such as in a chlor-alkali production process. In another example, an electrolytic cell may be configured to extract a metal as a product of interest using electrolysis of a molten salt. In yet another example, an electrolytic cell may be configured to produce a product of interest using an electroplating process. In these and other types of electrochemical process, a potential difference of at least a predefined amount, sometimes referred to as a cut-in voltage, may be applied across the electrodes of an electrolytic cell to initiate production of one or more products of interest.

In existing electrolytic cells, there is a limited range of current and voltage values over which the cells produce a product of interest without causing damage, safety problems or other concerns. If the current in these electrolytic cells falls below a critical point, the ionic gradient, or charging layer, of the electrolytic cell fails, causing irreversible damage to the cell. To shut down production of these existing cells, the potential difference across the electrodes is taken to zero, after which restarting production is a costly and time-consuming operation. Therefore, in order to avoid unplanned shutdowns, electrochemical plants that use these existing electrolytic cells must rely on the ability to completely control the electrical power supplied to the electrolytic cells.

Unlike in existing electrochemical plants, the systems described herein may have the ability to maintain multi-state electrolytic cells in a production-ready condition even when the potential difference across the electrodes is not sufficient for production of the product or products of interest. For example, these systems may include monitoring and control subsystems to detect whether a predefined set of production process conditions, such as temperature, pressure, pH, ionic strength, turbidity, or active species concentration, is being met and, if not, to initiate corrective action to return the multi-state electrolytic cells to the predefined set of production process conditions. The predefined set of production process conditions may be maintained while the multi-state electrolytic cells are operating in a production state associated with a first non-zero potential difference value in which one or more products of interest are being produced and while the multi-state electrolytic cells are operating in a safe idle state associated with a second, lower, non-zero potential difference value in which the product or products of interest are not produced.

Because the multi-state electrolytic cells are maintained in a production-ready condition while operating in the idle state, production may be quickly restarted at any time, allowing these systems to switch back and forth between the idle state and the production state repeatedly and frequently without damaging the products of interest being produced or the multi-state electrolytic cells themselves. The result is a reversible process that is fully curtailable and dispatchable. The ability to repeatedly and frequently switch between the idle and production states without causing damage to the products being produced or the multi-state electrolytic cells may allow an electrochemical plant to dynamically react to changes in the availability or price of electrical power supplied to the plant without ruining the products of interest being produced or damaging delicate and expensive equipment, including large numbers of electrolytic cells. For example, in some embodiments, an electrochemical plant may dynamically react to changes in the availability or price of electrical power supplied to the plant by a non-schedulable power source.

FIG. 1 is a block diagram illustrating selected elements of a system 100 for producing a product of interest using a multi-state electrolytic cell, in accordance with some embodiments. As illustrated in FIG. 1, system 100 may include an electrochemical plant 110 that produces a product of interest 140 using a multi-state electrolytic cell 112. For example, electrochemical plant 110 may produce a product of interest using electrolysis of an aqueous solution, electrolysis of a molten salt, an electroplating process or another electrochemical process that has a cut-in voltage. The multi-state electrolytic cell 112 may, at different times, operate in a production state in which the product of interest 140 is produced and in a safe idle state in which the product of interest 140 is not produced but in which production process characteristics of the multi-state electrolytic cell 112 are maintained. For example, a predefined set of production process conditions including, but not limited to, a temperature range, a range of head gas pressures, a pH range, a range of values representing ionic strength, or an active species concentration range suitable for production of the product of interest 140 while in the multi-state electrolytic cell is operating in the production state may also be maintained while the multi-state electrolytic cell is operating in the idle state. This may allow production of the product of interest 140 in the electrochemical plant 110 to restart quickly when switching from the idle state to the production state.

As illustrated in FIG. 1, system 100 may include a non-schedulable power source 120 and a power transmission path 122 including a switch 125 for coupling and decoupling the non-schedulable power source 120 to electrochemical plant 110. In the illustrated embodiment, the non-schedulable power source is depicted as a wind farm comprising multiple wind turbines. In other embodiments, the non-schedulable power source may be or include a concentrated solar power system, a photovoltaic power system, or another type of non-schedulable power source. System 100 may also include an electrical power grid 130 and a power transmission path 135 including a switch 132 for coupling and decoupling the electrical power grid 130 to electrochemical plant 110. In some embodiments, the electrical power grid 130 may be limited in its ability to receive power. In some embodiments, system 100 may include a power transmission path 114 including a switch 115 for coupling and decoupling the non-schedulable power source 120 to the electrical power grid 130.

In some embodiments, the non-schedulable power source 120 may supply electrical power to the electrical power grid 130 and the electrochemical plant 110 may receive electrical power from the electrical power grid 130, the amount or price of which is based on the availability of and demand for electrical power supplied to the electrical power grid 130 by the non-schedulable power source 120. The ability to quickly restart production of the product of interest 140 in the electrochemical plant 110 when switching from the idle state to the production state may allow the electrochemical plant 110 to take advantage of variations in the availability of and demand for electrical power to minimize the cost of producing the product of interest. For example, the electrochemical plant 110 may operate in a production state and receive electrical power supplied by the electrical grid 130 when the demand for, and corresponding price of, the electrical power supplied by the electrical grid 130 are low, and may switch to an idle state in which the product of interest is not produced when the demand for, and corresponding price of, the electrical power supplied by the electrical grid 130 are high. In another example, the electrochemical plant 110 may operate in a production state and receive electrical power supplied directly or indirectly by the non-schedulable power source 120 when the demand for, and price of, the electrical power generated by the non-schedulable power source 120 are low, may switch to an idle state in which the product of interest is not produced when the demand for, and corresponding price of, the electrical power generated by the non-schedulable power source 120 are high, and may switch back to a production state and receive electrical power supplied directly or indirectly by the non-schedulable power source 120 when the demand for, and price of, the electrical power generated by the non-schedulable power source 120 drop again.

System 100 may include an input resource pipe 152 including a valve 155 for selectively providing process inputs 150 to electrochemical plant 110. Input resource pipe 152 may be one of several pipes, portals, or other conveyance mechanisms through which respective process inputs are provided to electrochemical plant 110. Process inputs 150 may include any or all resources required for producing the product of interest 140 or for maintaining a predefined set of production process conditions including, but not limited to, a heat source, a cooling source, brine or another type of feedstock, an active species for replenishing the electrolyte within the multi-state electrolytic cell 112, additives such as an acid or base, recycled outputs of the electrochemical process, or gasses recovered from the electrochemical process.

System 100 may include a product output pipe 142 including a valve 145 for selectively outputting the product of interest 140 produced by electrochemical plant 110. In some embodiments, there may be more than one product of interest produced by the electrochemical process. In such embodiments, output resource pipe 142 may be one of several pipes, portals, or other conveyance mechanisms through which respective products of the electrochemical process are output from electrochemical plant 110. In various embodiments, a product of interest may be, or include, a solid, a liquid, or a gas. Examples of systems in which one or more products of interest are produced by a multi-state electrolytic cell that operates under a predefined set of production process conditions while in a production state and while in an idle state are illustrated in FIGS. 2, 4A, 4B, 5, 6, 7, 8, 9, and described below.

Like many existing electrolytic cells, the multi-state electrolytic cells described herein may include two tanks, each containing an electrolyte solution, two electrodes that are coupled to a direct current (DC) power source outside the tank, and an ionically conductive pathway between the two tanks. When a potential difference across the electrodes is suitable for production of a product of interest by a multi-state electrolytic cell, electrons are transferred across ionically conductive pathway. In accordance with a reduction-oxidation, or redox, reaction, a reduced product is produced on the side of the ionically conductive pathway that gains electrons and an oxidized product is produced on the side of the ionically conductive pathway that loses electrons. The products produced by the multi-state electrolytic cells described herein may be post-processed for distribution as products of commercial interest. For example, they may be distilled, filtered, cleaned, separated, compressed, heated, cooled, reacted with other feedstocks, or otherwise processed for distribution, in different embodiments.

Figure 2:
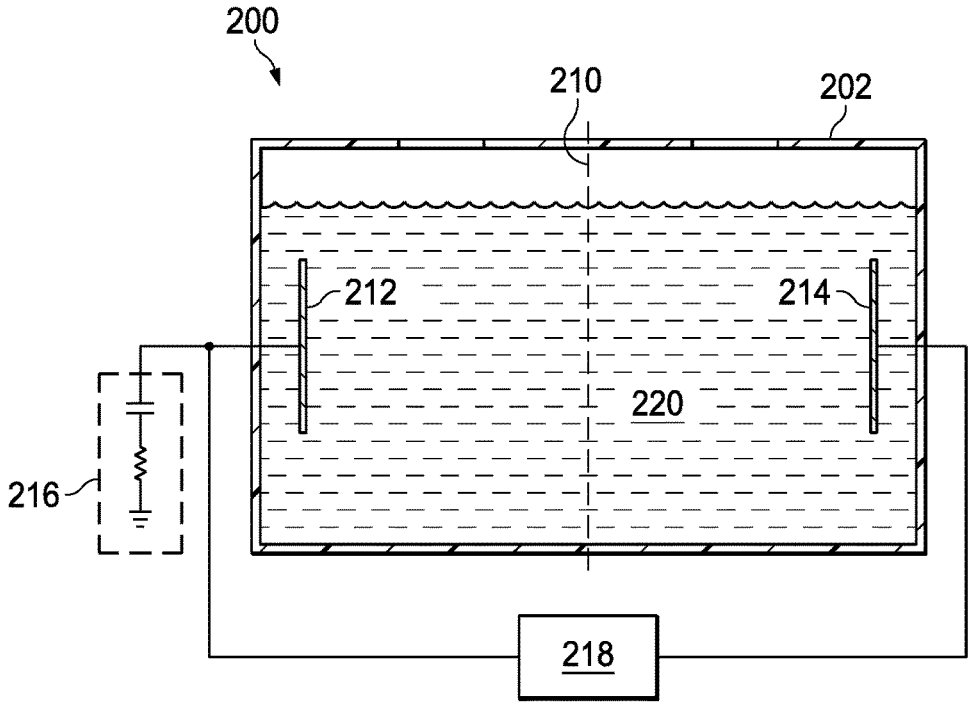
FIG. 2 is a block diagram illustrating selected elements of a multi-state electrolytic cell system, in accordance with some embodiments of the present disclosure.

FIG. 2 is a block diagram illustrating selected elements of a multi-state electrolytic cell system 200, in accordance with some embodiments. As illustrated in FIG. 1, multi-state electrolytic cell system 200 may include a multi-state electrolytic cell 202 for producing one or more products of interest through an electrochemical process that is fully curtailable and dispatchable, a variable controllable power circuit 218, and a bleed circuit 216. The multi-state electrolytic cell 202 also includes two electrodes, shown as a cathode 212 and an anode 214, and an ionic pathway 210 between the electrolytes on either side of the ionic pathway 210 through which some ions can cross but other ions and electrons cannot cross. In the illustrated embodiments, the ionic pathway 210 is a membrane. In other embodiments, the ionic pathway 210 may be a salt bridge, a glass tube, or any other suitable charge balance mechanism.

The variable controllable power circuit 218 may be configured to apply different potential differences across the cathode 212 and the anode 214 at different times, each associated with a respective one of the multiple operating states of the multi-state electrolytic cell 202. In certain embodiments, or at certain times, the variable controllable power circuit 218 may be supplied with electrical power from an electrical power grid such as electrical power grid 130 illustrated in FIG. 1. In certain embodiments, or at certain times, the variable controllable power circuit 218 may be supplied with electrical power generated by a non-schedulable power source such as non-schedulable power source 120 illustrated in FIG. 1 and described above. In some embodiments, or at certain times, the variable controllable power circuit 218 may be supplied with electrical power from multiple available power sources and may select a power source for the application of a given potential difference across the electrodes to initiate operation of the multi-state electrolytic cell 202 in a particular operating state. The variable controllable power circuit 218 may include any suitable custom or commercially available technology to control the potential difference applied across the cathode 212 and the anode 214, as well as the source of the electrical power. For example, the output voltage or current may be programmed using mechanical means, such as knobs or other mechanical switching elements or using one or more control signals. Similarly, the source of the electrical power may be selected using mechanical means, such as knobs or other mechanical switching elements or using one or more control signals. The potential difference applied across the cathode 212 and the anode 214 by the variable controllable power circuit, as well as the source of the electrical power, may be controlled locally, such as by a power circuit controller within the variable controllable power circuit 218, or may be controlled by digital or analog control signals received by the variable controllable power circuit 218 from another component of the multi-state electrolytic cell system 200 or from a remote component, in different embodiments.

In some embodiments, the variable controllable power circuit 218 may include a state monitor configured to determine in which of the multiple operating states the multi-state electrolytic cell 202 is operating. In some embodiments, the state monitor may be an element of a power circuit controller within 218. In other embodiments, the state monitor may be an element of a real-time monitoring and control subsystem in another portion of the multi-state electrolytic cell system 200. In some embodiments, the state monitor may provide an indication of the operating state of the multi-state electrolytic cell 202 to one or more real-time monitoring and control subsystems or to another component of the multi-state electrolytic cell system 200.

The operating states of the multi-state electrolytic cell 202 may include one or more production states in which a product of interest is produced and a predefined set of production process conditions of the multi-state electrolytic cell 202 are maintained. For example, during operation of the multi-state electrolytic cell 202 in each of the one or more production states, any or all of the temperature, head gas pressure, pH, ionic strength, turbidity, and active species concentration may be maintained within predefined ranges suitable for production of the product of interest. The operating states may also include an idle state in which the product of interest is not produced, but the predefined set of production process conditions of the multi-state electrolytic cell 202 are maintained. For example, the temperature, head gas pressure, pH, ionic strength, and active species concentration may be maintained within the same predefined ranges as when the multi-state electrolytic cell is operating in any of the production states. When a first non-zero potential difference is applied across the cathode 212 and the anode 214, this may initiate production of a product of interest in a particular production state. When a second non-zero potential difference lower than the first non-zero potential difference is applied across the cathode 212 and the anode 214, this may initiate operation in the idle state. In some embodiments, the electrodes may be polarizable electrodes designed to minimize the activation potential, or the over potential. In some embodiments, the multi-state electrolytic cell 202 may include three or more electrodes.

The multi-state electrolytic cell 202 may include one or more tanks each containing a feedstock 220, such as an active species in an aqueous or molten electrolyte solution. For example, if the multi-state electrolytic cell 202 is configured for an electroplating process, the multi-state electrolytic cell 202 may include only a single tank. On the other hand, if the multi-state electrolytic cell 202 is configured for any of a variety of aqueous or molten salt based electrochemical processes, it may include two or more tanks. For example, when configured for BPMED (BiPolar Membrane ElectroDialysis), the multi-state electrolytic cell 202 may include three tanks. In other embodiments, the multi-state electrolytic cell 202 may include more than three tanks. In some embodiments in which there are two or more tanks or domains, the tanks may initially contain the same feedstock, although the composition of the feedstock in the two tanks may change during production of the product of interest such that they are subsequently different. In some embodiments in which there are two or more tanks, the tanks may initially contain different feedstocks. In some embodiments, the multi-state electrolytic cell 202 may include a gaseous electrolyte. In some embodiments, the multi-state electrolytic cell 202 may include a solid electrolyte, such as in a Solid Oxide Electrochemical Cell.

As illustrated in FIG. 2, the multi-state electrolytic cell system 200 may include a bleed circuit 216 coupled to the cathode 212 and in parallel with the output of the variable controllable power circuit 218. In at least some embodiments, when the multi-state electrolytic cell 202 is operating in the idle state, where the potential difference across the cathode 212 and the anode 214 is below the half-cell potential, the potential difference is still sufficient to cause a charge to build up on the casing, bolts, or other metal components of the multi-state electrolytic cell 202. The bleed circuit 216, which includes capacitive and resistive elements, may allow the charge that builds up while the multi-state electrolytic cell 202 is operating in the idle state to discharge to ground. In some embodiments, the multi-state electrolytic cell system 200 may be configured to capture the heat generated by the bleed circuit 216 to heat the multi-state electrolytic cell system 200.

Figure 3:
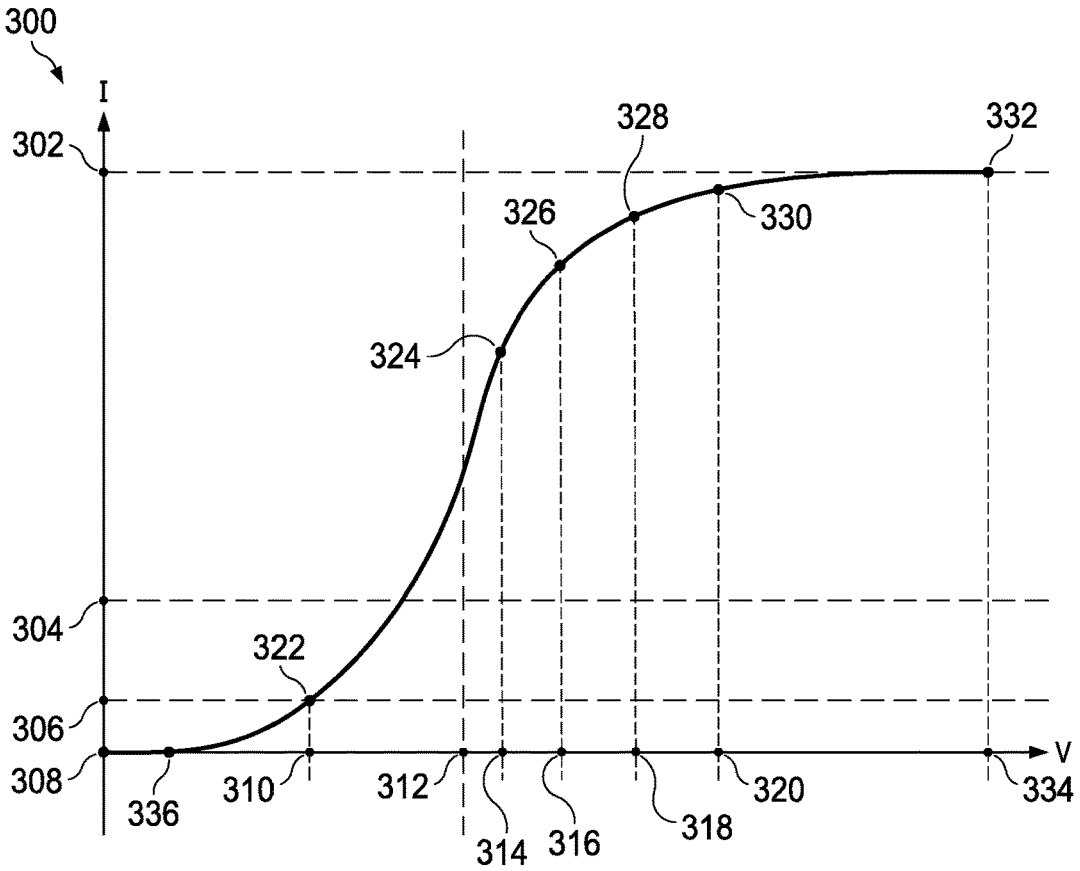
FIG. 3 illustrates a production curve for an electrochemical process using a multi-state electrolytic cell, in accordance with some embodiments of the present disclosure.

FIG. 3 illustrates a production curve 300 for an electrochemical process using a multi-state electrolytic cell, in accordance with some embodiments. More specifically, production curve 300 maps the current (i) flowing in the multi-state electrolytic cell to the corresponding potential difference (V) between the anode and the cathode of the multi-state electrolytic cell. Particular points along production curve represent respective operating states of the multi-state electrolytic cell.

In FIG. 3, a current value labeled as 302 on the y-axis may represent a maximum current limit for the cell. Point 308 on the production curve may represent a point at which both the potential difference between the anode and the cathode and the current flowing in a multi-state electrolytic cell, as described herein, are zero. A voltage value labeled as 312 on the x-axis may represent the half-cell potential, or $E_{1/2}$, for the multi-state electrolytic cell. In some embodiments, this may correspond to the potential difference at which the multi-state electrolytic cell begins to produce a product of interest with reasonable quality.

Point 324 on the production curve represents a first labeled production state at which a product of interest is produced by the multi-state electrolytic cell. The potential difference at this point is shown as 314 on the x-axis. Similarly, point 326 represents a second labeled production state associated with a potential difference shown as 316 on the x-axis, point 328 represents a third labeled production state associated with a potential difference shown as 318 on the x-axis, point 330 represents a fourth labeled production state associated with a potential difference shown as 320 on the x-axis, and point 332 represents a fifth labeled production state associated with a potential difference shown as 334 on the x-axis. In all of the production states 324 through 332, the multi-state electrolytic cell may operate under the same predefined production process conditions to produce the product of interest. However, the rate of production of the product of interest and the rate at which process resources are consumed may be different in different ones of the production states 324 through 332. In some embodiments, in order to operate at a lower potential difference, one or more actions may need to be taken to maintain the predefined production process conditions including, but not limited to, increasing the bleed rate, increasing the parasitic loads, generating and applying back pressure, balancing the pH, adjusting the active species concentration, or activating a heating or cooling element. Therefore, consumption of various resources will change. In one example involving a chlor-alkali process, in order to maintain the flow rate at a lower production of chlorine, iodine, fluorine, or other reduced product, the brine may need to be acidified at a higher rate.

In some embodiments, point 332 may correspond to a production state in which the rate of production of the product of interest is maximized. In embodiments in which two or more products of interest are produced, the multi-state electrolytic cell may produce a slightly different product mixture in each of the different production states. For example, if the electrolyte is a complex solution with multiple active species and the multi-state electrolytic cell is operating at high potential difference, the multi-state electrolytic cell may produce a mix of products including certain percentages or relative amounts of each product. However, when the potential difference is lower, the multi-state electrolytic cell may produce a different mix of products or a mix of products including different percentages or relative amounts of each product than would be produced at the higher potential difference. In some embodiments, when dealing with a multi-chemistry electrolyte, such as a wastewater that includes any number of compounds, there may be no "optimum" state. For any given potential difference, the cell may produce many products in a ratio that is dependent on the potential difference.

In FIG. 3, point 322 on production curve 300 represents an idle state in which no product of interest is produced although the process conditions under which the multi-state electrolytic cell operates in the idle state are the same as the predefined production process conditions under which the multi-state electrolytic cell operates in the production states. For example, temperature, pH, active species concentration, ionic strength, and head gas pressure may be maintained in the same predefined ranges as when the multi-state electrolytic cell is operating in any of the production states 324 through 332. As illustrated in FIG. 3, the potential difference when the multi-state electrolytic cell is operating in the idle state (at point 322) may be well below the $E_{1/2}$ point (312). The current flowing through the multi-state electrolytic cell in the idle state is shown as the current value 306 on the y-axis. The corresponding potential difference in the idle state is shown as the potential difference 310 on the x-axis.

For some existing electrolytic cells, there is a limited range of current and voltage values over which the cells produce a product of interest. With these existing electrolytic cells, the production process conditions change as the potential difference between the electrodes decreases. For example, a current value labeled as 304 on the y-axis in FIG. 3 may represent a current below which, in existing electrolytic cells, the ionic gradient of the electrolytic cell, sometimes referred to as the charging layer, is disrupted and begins to fail. Once the charging layer is gone, a cascade of changes may take place that cause irreversible damage to the cell, including the concentration of active species against the electrodes, a change in the pH of the electrolyte, a change in osmolarity of the electrolyte solution, a change in the reduction potential, and a change in the chemical activities that start to corrode the electrodes. Eventually, there may be too much of the active species in the electrolyte, such that active intermediates may start to reverse the current. The relationship between the maximum current limit and the current at which the charging layer is disrupted in existing electrolytic cells may be dependent on the particular chemistry of the electrolytic cell. For example, for existing electrolytic cells configured for a chlor-alkali process, the current at the point at which the charging layer is disrupted may be approximately 20% of the maximum current limit. For existing electrolytic cells having other chemistries, the current at the point at which the charging layer is disrupted may be greater or less than 20% of the maximum current limit for the electrolytic cell.

In the multi-state electrolytic cells described herein, however, production process conditions such as temperature, pH, active species concentration, ionic strength, and head gas pressure, are maintained even as the potential difference between the electrodes is significantly decreased and the current falls below what would otherwise have been the point at which the charging layer is disrupted in an electrolytic cell of a particular chemistry. The result is a reversible process that is fully curtailable and dispatchable in which the potential difference between the electrodes of the multi-state electrolytic cell can be quickly ramped down to an idle state at which no product of interest is produced and quickly ramped back up to a state at which production of the product of interest resumes. In some embodiments, the multi-state electrolytic cells described herein may be ramped from a production state down to the idle state or from the idle state up to a production state in a matter of minutes, rather than taking hours or days as with existing electrolytic cells, and this cycle may be repeated many times in a single day. For example, a multi-state electrolytic cell for chlor-alkali production, such as the multi-state electrolytic cells illustrated in FIGS. 4A and 4B and described below, may be ramped from a maximum production state down to the idle state in less than five minutes, or a single SCED run subject to limitations beyond the battery limit.

Production curve 300 may represent the behavior of any of a variety of electrochemical processes that may benefit from an ability to maintain a predetermined set of production process conditions while moving between production states or while moving between a production state and an idle state, including, but not limited to, electrolysis of an aqueous solution, electrolysis of a molten salt, an electroplating processes or any electrochemical process that has a cut-in voltage. One example of such a process is a chlor-alkali process, which uses electrolysis of an aqueous solution to produce chlorine. On average, a potential difference between the electrodes of a multi-state electrolytic cell of approximately 3.2 volts may be suitable for commercial production of the products of interest for a chlor-alkali process, although this may vary for particular cell designs. On average, a potential difference between the electrodes of a multi-state electrolytic cell of approximately 1.36 volts may represent the cut-in voltage below which production of chlorine stops, although this may vary for particular cells designs. In embodiments in which the production state is associated with a potential difference of 3.2 volts and the cut-in voltage is 1.36 volts, a potential difference of approximately 1.29 volts may be the target voltage associated with the idle state. As described in more detail below, a variable controllable power circuit in the multi-state electrolytic cell system may prevent the potential difference from falling below the target idle state voltage to avoid inducing reverse currents, damaging the multi-state electrolytic cell, or rendering the input resources of the chlor-alkali process unsuitable for producing the products of interest upon restarting production.

In a multi-state electrolytic cell configured for a chlor-alkali process, the feedstock may be brine: saturated sodium chloride in water, with between 23% and 25% sodium chloride. In this example, the electrode material may only stable at low pH. In addition, the primary product of interest, which is chlorine in gaseous form, is stable at approximately 3 pH, with unwanted side reactions occurring if the pH is above 4. Therefore, the feedstock may be acidified by the drop-wise addition of hydrochloric acid until reaching an appropriate molarity or proton activity to provide pH control. Other inputs to the chlor-alkali process may include a sodium hydroxide solution in water at 30%.

An additional output of the chlor-alkali process may be a sodium hydroxide solution in water at 32%. In some embodiments, the additional 2% sodium hydroxide may be extracted and separated into a 50% sodium hydroxide solution and 30% sodium hydroxide, with the 30% sodium hydroxide being recycled as an input to the chlor-alkali process. The 50% sodium hydroxide solution is a value-added chemical that may be distributed as a liquid or further processed into caustic soda in flake or lye tablet form, which is a solid. In some embodiments, the chlorine produced by the chlor-alkali process may be post-processed using a drier process and may also be refined prior to commercial distribution. The hydrogen produced by the chlor-alkali process may be used as is, may be vented, may be burned, or may be recombined to produce hydrochloric acid or combined with other feedstocks for commercial distribution.

In order to switch the operating state of a multi-state electrolytic cell configured for a chlor-alkali process from the production state to the idle state, the potential difference across the electrodes may be lowered in a controlled fashion such that the production process conditions are maintained within the multi-state electrolytic cell even as the charged species stop moving across the ionically conductive pathway. The first steps for switching to the idle state, which in some embodiments may be taken substantially in parallel, are to drop the potential difference across the electrodes from a value of approximately 3.2 volts to a value of approximately 1.29 volts, for example, and to begin feeding nitrogen (or any inert gas) into the multi-state electrolytic cell to purge out the chlorine in the cell, thus protecting the electrodes. In some embodiments, the potential difference may be lowered using a decay pattern that is not linear, such as a log function of a large capacitor. In some embodiments, an inert gas such as nitrogen may be injected into the multi-state electrolytic cell (e.g., from below) on either side of the ionically conductive pathway, adding supplemental gas that will purge out the chlorine and that will also help maintain the head gas back pressure despite any small leaks throughout the system. For example, nitrogen may enter the multi-state electrolytic cell as bubbles that physically travel through the system and bubble up to the head space gas. Along the way, they may strip the chlorine out of the electrolyte so that when the potential difference between the electrodes reaches the potential difference associated with the idle state, the chlorine is no longer present in the electrode. In one example embodiment in which the potential difference is lowered substantially in parallel with the nitrogen (or other inert gas) purge, it may take approximately 18 seconds for these two steps to be completed. In some embodiments, the nitrogen purge may be initiated prior to starting to drop the potential difference across the electrodes such that the first nitrogen bubbles hit the charge plate as drop in the potential difference begins. In some embodiments, rather than purging out the chlorine using nitrogen, the chlorine may be purged using another inert gas, such as argon or krypton.

Additional actions to be taken when moving from the production state to the idle state in a multi-state electrolytic cell configured for a chlor-alkali process may include adjusting a controllable back pressure pump or check valve to maintain the head space pressure in the same pressure range as when the cell was operating in the production state, and adding fresh acid, such as hydrochloric acid, to maintain the pH in the same range as when the cell was operating in the production state. For a multi-state electrolytic cell configured for a process other than a chlor-alkali process, an acid or base may be added to maintain the pH within predefined production process conditions for the specific process.

Figure 4A:
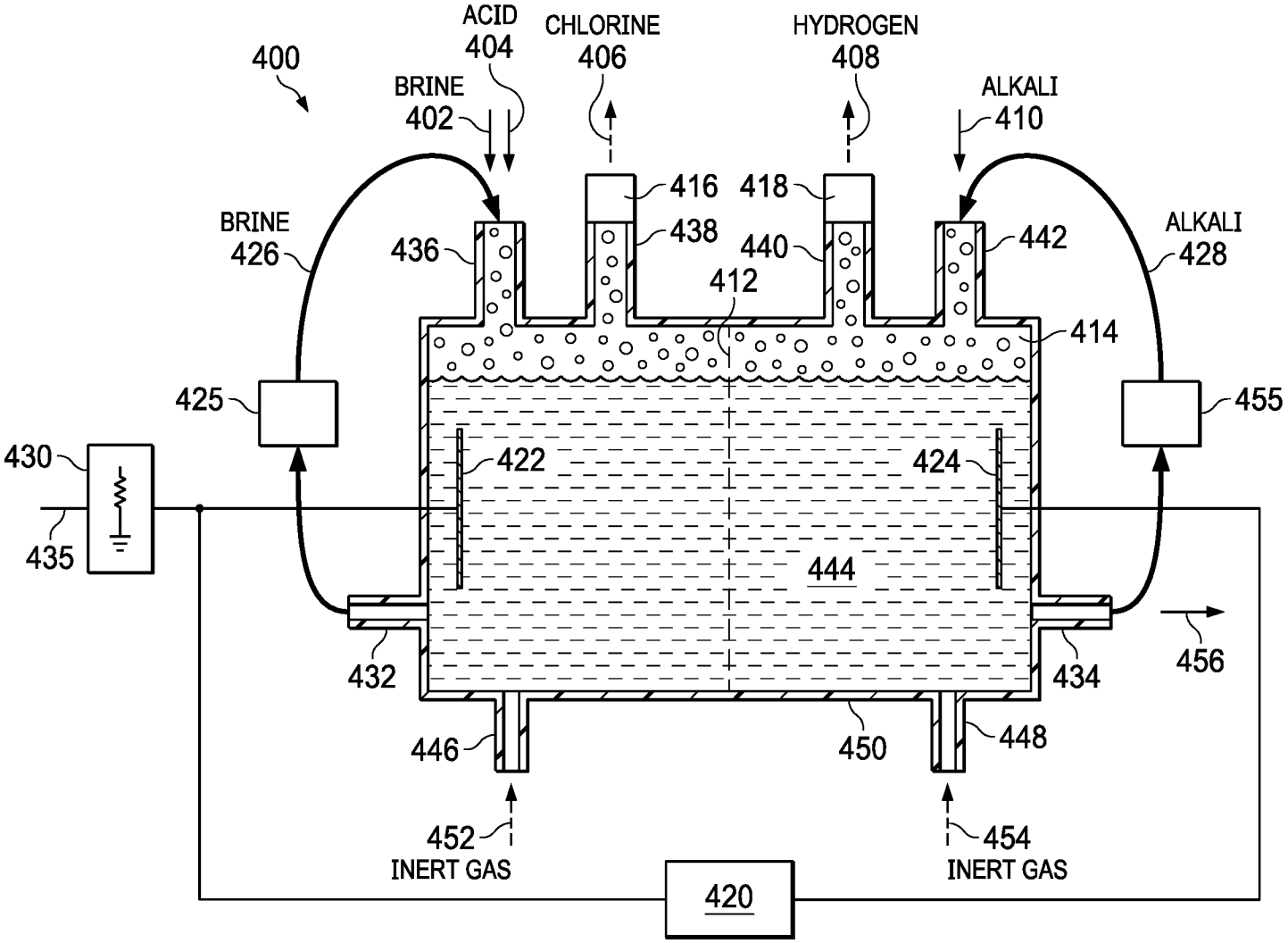
FIGS. 4A through 4D are block diagrams illustrating selected elements of a multi-state electrolytic cell system 400 for a chlor-alkali process, in accordance with some embodiments of the present disclosure.

FIGS. 4A through 4D are block diagrams illustrating selected elements of a multi-state electrolytic cell system for a chlor-alkali process, in accordance with some embodiments. In FIG. 4A, multi-state electrolytic cell system 400 includes a multi-state electrolytic cell 450, a variable controllable power circuit 420, and a heater circuit 430. When multi-state electrolytic cell 450 is in a production state, it operates under a predefined set of production process conditions and produces chlorine, an alkali, such as sodium hydroxide, and hydrogen, as described above.

Multi-state electrolytic cell 450 includes a cathode 424, an anode 422, and an ionic pathway 412 between the cathode side and the anode side of electrolytic cell 450. In the illustrated example, the ionic pathway 412 is a membrane, such as a plastic polymer membrane that exhibits high anion rejection, through which positive ions can cross, but negative ions cannot cross. In other embodiments, the ionic pathway 412 may be or include a glass tube or other suitable element, or a membrane made of another type of plastic or other material. As illustrated in FIG. 4A, multi-state electrolytic cell 450 includes a feedstock 444 containing active species for the production of the products of interest, specifically brine.

As illustrated in FIG. 4A, multi-state electrolytic cell 450 may include an input pipe 436 for receiving brine 402, hydrochloric acid 404 and, in some embodiments, recycled brine. In some embodiments, previously acidified brine may be introduced into the multi-state electrolytic cell at input pipe 436. Multi-state electrolytic cell 450 may also include an output pipe 438 through which chlorine 406 produced by cell 450 is output as a product of the chlor-alkali process, and an output pipe 440 though which hydrogen 408 produced by cell 450 is output as a product of the electrochemical process. Multi-state electrolytic cell 450 may also include an output pipe 432 for recycling depleted brine 426 back to input pipe 436 as an input to the electrochemical process. This recycling loop may include a processing element 425 at which the recycled brine may be cleaned, heated, cooled, enriched, acidified, or otherwise treated before being reintroduced into the multi-state electrolytic cell 450 at input pipe 436.

In the illustrated embodiment, multi-state electrolytic cell 450 includes an input pipe 442 through which an alkali 410, such as sodium hydroxide or caustic, and a recycled alkali 428 such as weak sodium hydroxide or weak caustic, may be introduced into the cell. Multi-state electrolytic cell 450 may also include an output pipe 434 for providing an alkali 456, such as caustic, as a product of the electrochemical process and for recycling an alkali 428, such as weak caustic, back to input pipe 442 as an input to the electrochemical process. This recycling loop may include a processing element 455 at which the recycled alkali may be cleaned, heated, cooled, enriched, or otherwise treated before being reintroduced into the multi-state electrolytic cell 450 at input pipe 442.

As shown in FIG. 4A, multi-state electrolytic cell 450 may include an input pipe 446 for receiving an inert gas 452, such as nitrogen, argon, or krypton, on the anode side of the cell and an input pipe 448 for receiving an inert gas 454, such as nitrogen, argon, or krypton, on the cathode side of the cell to purge chlorine when the multi-state electrolytic cell 450 is entering or operating in the idle state. Head gases in the multi-state electrolytic cell 450 are shown as head gases 414. Output pipe 438 may include a back pressure pump 416 for maintaining a particular head gas pressure on the anode side of the cell. Similarly, output pipe 440 may include a back pressure pump 418 for maintaining a particular head gas pressure on the cathode side of the cell.

In FIG. 4A, a brine recirculation loop for depleted brine 426 from output pipe 432 to input pipe 436 may be configured to re-concentrate the depleted brine prior to reintroducing it into the multi-state electrolytic cell 450. For example, the depleted brine may include between 15% and 20% sodium chloride, which may be re-concentrated back up to between 23% and 25% sodium chloride prior to being pumped back into the cell at input pipe 436, with excess water being shunted away as a by-product or the process (not shown).

Heater circuit 430 is shown on the recirculation line for recycled brine 426, where it may heat the recycled brine prior to its reintroduction into the multi-state electrolytic cell 450. In this position, or in another position in the multi-state electrolytic cell system 400, heater circuit 430 may heat these or other input resources, or the multi-state electrolytic cell 450 as a whole, to maintain the temperature of the cell consistent with the predefined set of production process conditions. In some embodiments, the multi-state electrolytic cell system 400 may include a combination heating/cooling element, or separate heating and cooling elements, rather than a heater circuit alone. In some embodiments, there may be more than one heater circuit, or heating/cooling element, per cell. For example, in addition to the heater circuit 430 on the recirculation line for brine 426, there may be an auxiliary heater circuit, or an auxiliary heating/cooling element, on the opposite side of the cell, such as on the recirculation line for the alkali 428. While heater circuit 430 provides electrical heating, other heating/cooling elements in the multi-state electrolytic cell system 400 may provide other types of heating or cooling for maintaining the temperature of the cell consistent with the predefined set of production process conditions when moving between production states or when moving between a production state and an idle state. For example, the more rapidly production is ramped up, the more heat is generated, which may result in a need for cooling to maintain the temperature within the predefined range. In some embodiments, the heater circuit 430, or an auxiliary heater, need not be energy consuming, but may be or include a heat reservoir, such as a molten salt reservoir or another energy storage reservoir. In some embodiments, a heat reservoir may be pumped by solar storage, or another mechanism that is cycled to maintain the temperature of the multi-state electrolytic cell 450. In some embodiments, a control signal 435 may be provided to the heater circuit 430 from a local or remote controller, such as one of the monitoring and control subsystems described herein, to activate or deactivate the heating and cooling functions of the heater circuit 430.

In the illustrated embodiment, the variable controllable power circuit 420 is configured to apply different potential differences across cathode 424 and anode 422 at different times, placing multi-state electrolytic cell 450 in different operating states. In some cases, or at certain times, the variation in the potential difference may be due to a variation in the electrical power received from a DC power source, such as when electrical power is supplied by a non-schedulable power source. In some embodiments, or at certain times, the variation in the potential difference may be controlled locally by circuitry within the variable controllable power circuit 420 to control the voltage and current at the cell level. In other embodiments, or at certain times, the variation in the potential difference may be controlled collectively for a group of multi-state electrolytic cells, such as a stack or rack of multi-state electrolytic cells 450. The variable controllable power circuit 420 may include any suitable custom or commercially available variable controllable power source to manipulate the potential difference across cathode 424 and anode 422 to effect a change in the operating state of the multi-state electrolytic cell 450.

As noted above, when multi-state electrolytic cell 450 is in a production state, it operates under a predefined set of production process conditions and produces chlorine, an alkali, and hydrogen. When the multi-state electrolytic cell 450 is operating in an idle state associated with a second, lower, non-zero potential difference, no products are produced. For example, multi-state electrolytic cell 450 may be configured to operate in a production state in which chlorine, alkali, and hydrogen are produced when the potential difference between the electrodes is greater than 1.36 volts or, preferably, approximately 3.2 volts, and in an idle state in which none of these products are produced when the potential difference between the electrodes is less than 1.36 volts or, preferably, approximately 1.29 volts. However, a predefined set of production process conditions may be maintained in the multi-state electrolytic cell regardless of whether the cell is operating in any of one or more production states or is operating in the idle state. The rate of production of the products of interest may be higher when the potential difference is at the upper end of the production voltage range than when the potential difference is at the lower end of the production voltage range. In some embodiments, the rate at which input resources for the chlor-alkali process are consumed may be higher when the rate of production is higher and may be lower when the rate of production is lower. In some embodiments, multi-state electrolytic cell 450 may produce chlorine, an alkali, and hydrogen in slightly different amounts or relative ratios dependent on the particular production state in which the cell is operating.

Figure 4C:
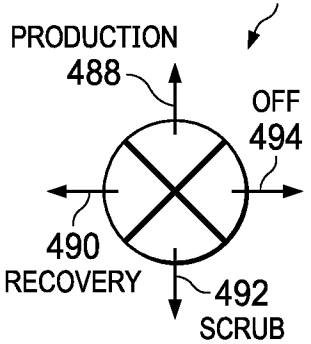
Figure 4D:
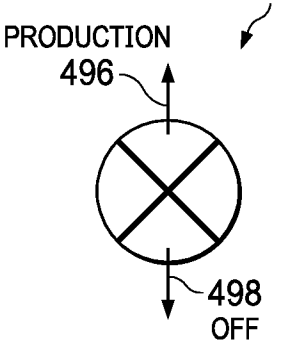
Figure 4B:
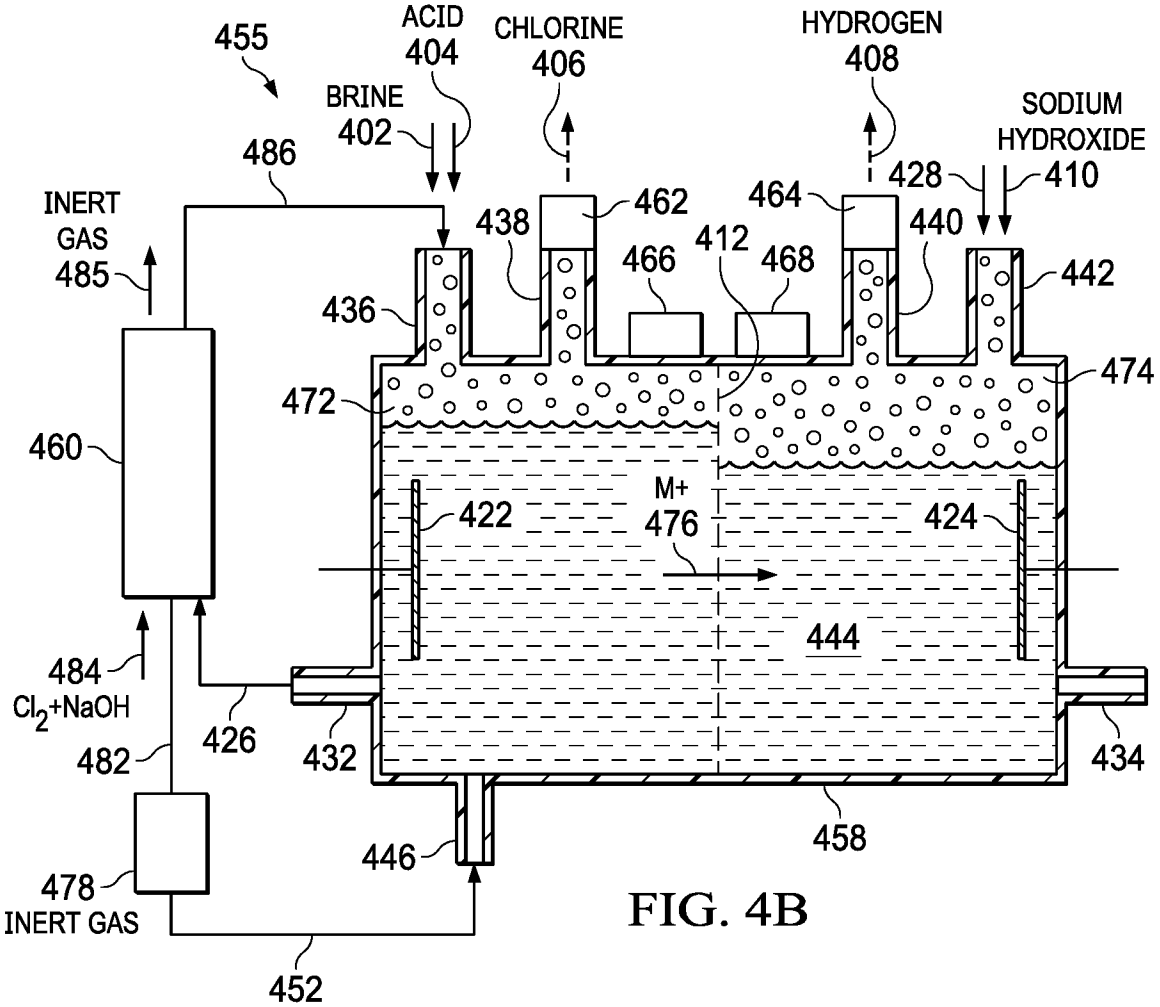

FIG. 4B illustrates selected elements of a multi-state electrolytic cell system 455 for a chlor-alkali process, in accordance with some embodiments. Multi-state electrolytic cell system 455 may include one or more elements shown in 400 in FIG. 4A that are not shown in 4B for simplicity. Elements shown in FIG. 4B and having the same reference numbers as corresponding elements shown in FIG. 4A may be substantially similar. In FIG. 4B, multi-state electrolytic cell system 455 includes a multi-state electrolytic cell 458, a purge element 460, and a storage tank 478. In some embodiments, multi-state electrolytic cell system 455 may also include a variable controllable power circuit, such as variable controllable power circuit 420 illustrated in FIG. 4A, and a heater circuit, such as heater circuit 430 illustrated in FIG. 4A (not shown in FIG. 4B). When multi-state electrolytic cell 458 is operating in a production state associated with a first non-zero potential difference across the electrodes, the cell may operate under a predefined set of production process conditions to produce chlorine, sodium hydroxide, and hydrogen, as described above. As illustrated in FIG. 4B, during chlor-alkali production, cations, shown as $M^+$, 476 may cross ionic pathway 412 while the multi-state electrolytic cell 458 is operating in a production state. However, when multi-state electrolytic cell 458 is operating in an idle state associated with a second, lower, non-zero potential difference, the migration of cations 476 may be stopped altogether or may be reduced to an amount that is insufficient to produce chlorine, sodium hydroxide, or hydrogen.

As illustrated in FIG. 4B, one of the output ports of multi-state electrolytic cell 458 may include a four-way valve 462 for handling chlorine produced by cell 458. The four-way valve 462 is further illustrated in FIG. 4C and described below. As illustrated in FIG. 4B, one of the output ports of multi-state electrolytic cell 458 may include a two-way valve 464 for handling hydrogen produced by cell 458. The two-way value 464 is further illustrated in FIG. 4D and described below. In the illustrated embodiment, multi-state electrolytic cell 458 includes a back pressure pump 466 for maintaining an appropriate head gas pressure for head gas 472 on the anode side of the cell and a back pressure pump 468 for maintaining an appropriate head gas pressure for head gas 474 on the cathode side of the cell.

As illustrated in FIG. 4B, the multi-state electrolytic cell system 455 may include a storage tank 478 that supplies an inert gas 452, e.g., nitrogen, to the cathode side of cell 458 through input pipe 446. In some embodiments, storage tank 478 also supplies the inert gas 452 to cell 458 at an input pipe on the anode side of the cell, such as input pipe 448 illustrated in FIG. 4A (not shown in 4B). In the illustrated example, the inputs to purge element 460 on the brine recirculation line include $Cl_2$+NaOH (484), depleted brine (426), and inert gas (482) from storage tank 478. The outputs of purge element 460 include inert gas 485. In other embodiments, other inputs to purge element 460, such as an inert gas other than nitrogen, may be used to purge chlorine from the multi-state electrolytic cell system 455 when the multi-state electrolytic cell 458 is operating in the idle state. Restarting production from the idle state may include gradually ramping the potential difference across the electrodes back up to a potential difference associated with a production state, for example. In some embodiments, the return to a production state may be accelerated such that it is effectively instantaneous by adding the intermediates needed for chlorine production to the electrolyte, resulting in a much faster response time.

FIG. 4C illustrates the settings on four-way valve 462, in accordance with some embodiments. In the illustrated example, the settings include a production setting 488, a recovery setting 490, a "scrub tailings" setting 492, and an "off" setting 494. Setting the valve 462 to the production setting 488 causes the output of chlorine as a product of interest produced by the cell. Setting the valve 462 to the recovery setting 490 causes chlorine to be routed to a recovery compressor (not shown). Setting the valve 462 to the "scrub tailings" setting 492 causes the output gas at the valve to be routed to another component of the system (not shown) to a scrub the tailings. To scrub the tailings, an inert gas may be bubbled through the output gas in the head space in order to push the chlorine out. Initially, the chlorine may be output at the target production concentration in the output gas. However, at some point, the concentration of chlorine will drop. Once the chlorine concentration hits a certain point, such as between 90% chlorine and 10% chlorine, for example, this may represent a recoverable amount, and the output gas may be routed to a recovery compressor. The recovery compressor may be a chlorine compressor that compresses the gas mix such that the chlorine liquefies, but the nitrogen does not. In this case, the liquid chlorine is a recovered product. Eventually, the concentration of chlorine in the output gas will drop below a recoverable limit, at which point it may be neutralized by diluting it through water or scrubbing it with sodium hydroxide, for example. The valve 462 may be set to the "off" setting 494 once there is no chlorine present in the output gas. Although a four-way value is shown in FIG. 4C, in other embodiments valve 462 may have more, fewer, or different settings. For example, in some embodiments, all of the output gas may be routed to a recovery compressor, after which the non-condensable materials may be routed to another element in order to scrub the tailings. In this example, the recovery compressor would output producible chlorine, for example, and tailings to be scrubbed.

FIG. 4D illustrates the settings on two-way valve 464, in accordance with some embodiments. In the illustrated example, the settings include a production setting 496 and an "off" setting 498. Setting the valve 464 to the production setting 496 causes the output of hydrogen as a product of interest produced by the cell. The valve 464 may be set to the "off" setting 498 once there is no hydrogen in the output gas at valve 464. Although a two-way value is shown in FIG. 4D, in other embodiments, valve 464 may have more than two settings, including, for example, a setting to route at least a portion of the hydrogen produced by the cell to another component in the system for another purpose. In some embodiments, multi-state electrolytic cells with similar or difference chemistries than those used in a chlor-alkali process may include valves to control the routing and distribution of the products of the particular electrochemical process at different times and under particular conditions, some of which may be similar to those illustrated in FIGS. 4C and 4D.

While FIGS. 4A through 4D illustrate example embodiments of multi-state electrolytic cells and systems configured for a chlor-alkali process, in other embodiments, multi-state electrolytic cells and systems configured for a chlor-alkali process may include more, fewer, or different elements than those illustrated in FIGS. 4A through 4D, or may include any of the elements illustrated in FIGS. 4A through 4D in different combinations than those shown in FIGS. 4A through 4D. Similarly, multi-state electrolytic cells with similar or difference chemistries than those used in a chlor-alkali process may include any of the elements illustrated in FIGS. 4A through 4D in the same or different combinations than those shown in FIGS. 4A through 4D.

In some embodiments, a multi-state electrolytic cell may include a bi-polar membrane that provides multiple ionically conductive pathways, allowing ions from an electrolyte solution in water originating in the middle of the cell to cross a respective one of the membranes on either side of the multi-state electrolytic cell. In one such embodiment, the electrochemical process performed by the multi-state cell may involve the removal of species from the electrolyte solution and the product of interest may be purified water. In general, a multi-state electrolytic cell configured for an electrodialysis process may produce a modified or purified feedstock as the product of interest.

Figure 5:
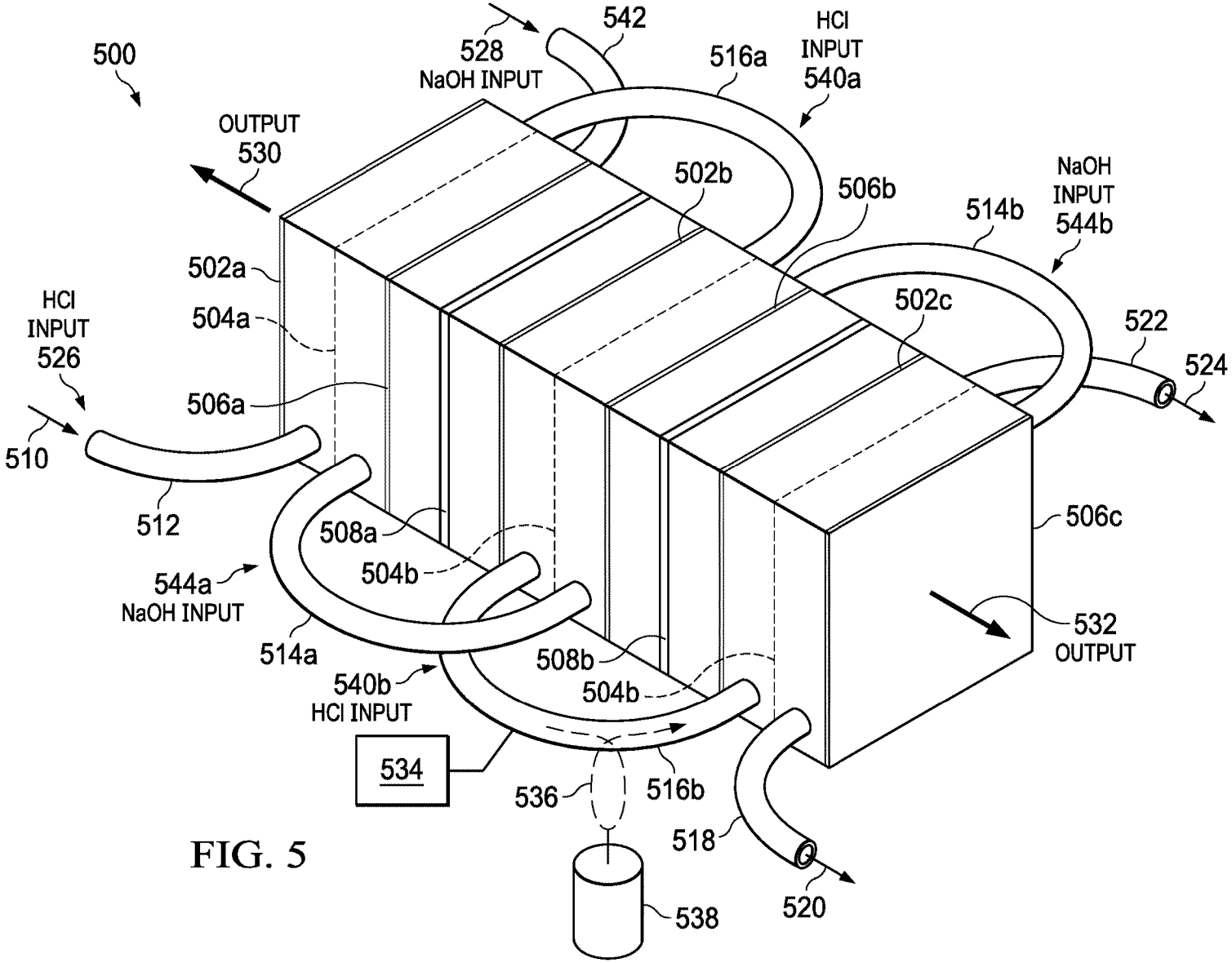
FIG. 5 is a block diagram illustrating selected elements of an electrolytic cell assembly including three multi-state electrolytic cells, in accordance with some embodiments of the present disclosure.

In a typical electrochemical plant, a large number of electrolytic cells may be assembled such that they work together to produce large quantities of a product of interest. For example, the electrochemical plant may include a large array of assemblies, each including several electrolytic cells. FIG. 5 is a block diagram illustrating selected elements of an electrolytic cell assembly 500 for a chlor-alkali process including three multi-state electrolytic cells, in accordance with some embodiments. Such an assembly may sometimes be referred to as a "rack" or "stack" of multi-state electrolytic cells. Each of the multi-state electrolytic cells includes a respective cathode, shown as 502*a* through 502*c*, a respective membrane, shown as 504*a* through 504*c*, and a respective anode, shown as 506*a* through 506*c*. In the illustrated embodiment, the multi-state electrolytic cells are configured for a chlor-alkali process, the width of each of the cells is on the order of 1 to 5 centimeters, and there is a plastic nonconductive plate separator between the cells in the electrolytic cell assembly 500. In other embodiments, a rack of multi-state electrolytic cells may include a number of cells other than three.

In the illustrated embodiment, the multi-state electrolytic cells are placed side-by-side with various input resources and products of the chlor-alkali process flowing from one cell to the next using a collection of pipes. For example, electrolytic cell assembly 500 includes input pipe 512 through which brine enters electrolytic cell assembly 500, input pipe 542 through which sodium hydroxide 528 enters electrolytic cell assembly 500, brine pipes 516*a* and 516*b* through which depleted brine flows from one cell to its neighbor cell, and caustic pipes 514*a* and 514*b* through which weak caustic flows from one cell to its neighbor cell. Additional locations along caustic pipes 514*a* and 514*b* at which sodium hydroxide may be added to maintain production process conditions are shown as 544*a* and 544*b*, respectively. Electrolytic cell assembly 500 also includes output pipe 518 for outputting caustic 520 as a product of the collective cells of the electrolytic cell assembly 500 and output pipe 522 for outputting or recycling depleted brine 524. As shown at 526, hydrogen chloride may be input to the first cell in the electrolytic cell assembly 500 as needed to maintain the pH of the first cell or of the electrolytic cell assembly 500 as a whole within a predefined allowable range, such as a range defined for the predefined set of production process conditions. Additional locations along brine pipes 516*a* and 516*b* at which hydrochloric acid may be added to maintain pH for production process conditions are shown as 540*a* and 540*b*, respectively. Not shown in FIG. 5 are output pipes for the chlorine and hydrogen produced by the multi-state electrolytic cells of electrolytic cell assembly 500, which may be similar to those illustrated in FIGS. 4A and 4B but are omitted from FIG. 5 for clarity. In the embodiment illustrated in FIG. 5, these output pipes may be located on the top side of electrolytic cell assembly 500.

As illustrated in FIG. 5, electrolytic cell assembly 500 may include a heating/cooling element 534 for maintaining the temperature of electrolytic cell assembly 500, or particular portions thereof, within a predefined allowable range. For example, heating/cooling element 534 may, at various times, be configured for heating or cooling input resources for the electrolytic cell assembly 500, such as brine, for heating or cooling an individual cell, or for heating or cooling an entire rack. While heating/cooling element 534 is shown coupled to brine pipe 516*b* in FIG. 5, one or more heating/cooling elements may be located elsewhere within the electrolytic cell assembly 500 instead or in addition to heating/cooling element 534. For example, in some embodiments, the electrolytic cell assembly 500 may include a respective heating/cooling element per electrolytic cell. In other embodiments, the electrolytic cell assembly 500 may include one heating/cooling element for multiple electrolytic cells or a single heating/cooling element for an entire rack of electrolytic cells in the electrolytic cell assembly 500.

In the illustrated example, electrolytic cell assembly 500 includes a recirculation loop 536 in which nitrogen or chlorine may be used for purging operations, such as those described herein. Electrolytic cell assembly 500 may also include one or more storage tanks 538 for supplying nitrogen or chlorine for purging operations. In embodiments in which a nitrogen purge is implemented, the nitrogen may be introduce on both sides of the electrolytic cell assembly 500 so that the entire electrolytic cell assembly 500 can be purged simultaneously, thus avoiding gradients or other undesirable conditions. Also shown in FIG. 5 are electrical power output 530 and electrical power output 532, each of which is coupled to power circuitry (not shown) in the electrochemical plant in which the electrolytic cell assembly 500 operates. In some embodiments, the power circuitry to which electrical power outputs 530 and 532 are coupled may be or include a variable controllable power circuit, such as variable controllable power circuit 218 illustrated in FIG. 2 or variable controllable power circuit 420 illustrated in FIG. 4.

Although not expressly shown in FIG. 5, the multi-state electrolytic cells of the electrolytic cell assembly 500 may include any or all of the elements of any of the multi-state electrolytic cells described herein in various combinations. In some embodiments, more, fewer, or different elements than those shown in FIG. 5 may be included in the electrolytic cell assembly 500 to maintain respective production process conditions For example, each of the multi-state electrolytic cells of the electrolytic cell assembly 500 may include one or more monitoring and control subsystems and corrective elements usable to maintain a predefined set of production process conditions in all production states and the idle state for that cell. In embodiments in which the multi-state electrolytic cells in the electrolytic cell assembly 500 have chemistries suitable for electrochemical processes other than a chlor-alkali process, the particular predefined sets of production process conditions and the system elements required for maintaining those conditions may be dependent on the chemistries of the multi-state electrolytic cells in the electrolytic cell assembly 500.

Figure 6:
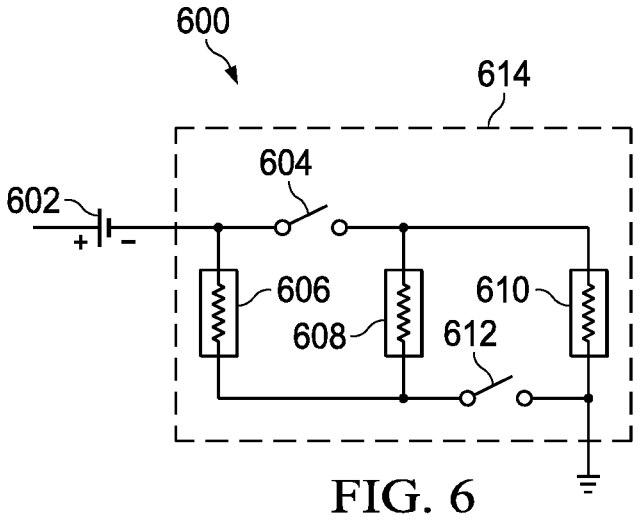
FIG. 6 is a block diagram illustrating selected elements of a macro cell including three multi-state electrolytic cells, in accordance with some embodiments of the present disclosure.

In some embodiments, a rack or stack of multi-state electrolytic cells, such as the three multi-state electrolytic cells of electrolytic cell assembly 500 illustrated in FIG. 5, may be treated as a single "macro cell" for certain purposes. FIG. 6 is a block diagram illustrating selected elements of electrolytic cell assembly 600 including a macro cell 614, in accordance with some embodiments. In the illustrated embodiment, macro cell 614 includes three multi-state electrolytic cells. More specifically, macro cell 614 includes three multi-state electrolytic cells shown as cells 606, 608, and 610. In other embodiments, macro cell 614 includes two multi-state electrolytic cells or more than three multi-state electrolytic cells.

As illustrated in FIG. 6, the three multi-state electrolytic cells 606, 608, and 610 may be represented as respective resistive elements that may be selectively configured in series or in parallel. In the illustrated example, macro cell 614 includes switches 604 and 612 for selectively configuring the three electrolytic cells within macro cell 614 in series or in parallel. When switch 604 and switch 612 are closed, the three electrolytic cells within macro cell 614 are configured as three resistive elements in parallel. Conversely, when switch 604 and switch 612 are open, the three electrolytic cells within macro cell 614 are configured as three resistive elements in series.

In some embodiments, switches 604 and 612 may be controlled by digital signals, either collectively or individually, through a real-time monitoring and control subsystem in the macro cell 614 or elsewhere in the electrochemical plant in which the macro cell 614 resides. In some embodiments, by controlling a series of switches in macro cell 614 and additional similar macro cells, different collections of cells may be switched between parallel and series configurations. In this way, the resistance across the rack may be change, which may also change the potential differences across the electrodes in various ones of the cells in each of the macro cells 614. In some embodiments, this approach may be used to move between production states or between a production state and an idle state. Other methods for changing the potential differences across the electrodes in various ones of the cells in macro cell may be implemented in other embodiments.

Figure 7:
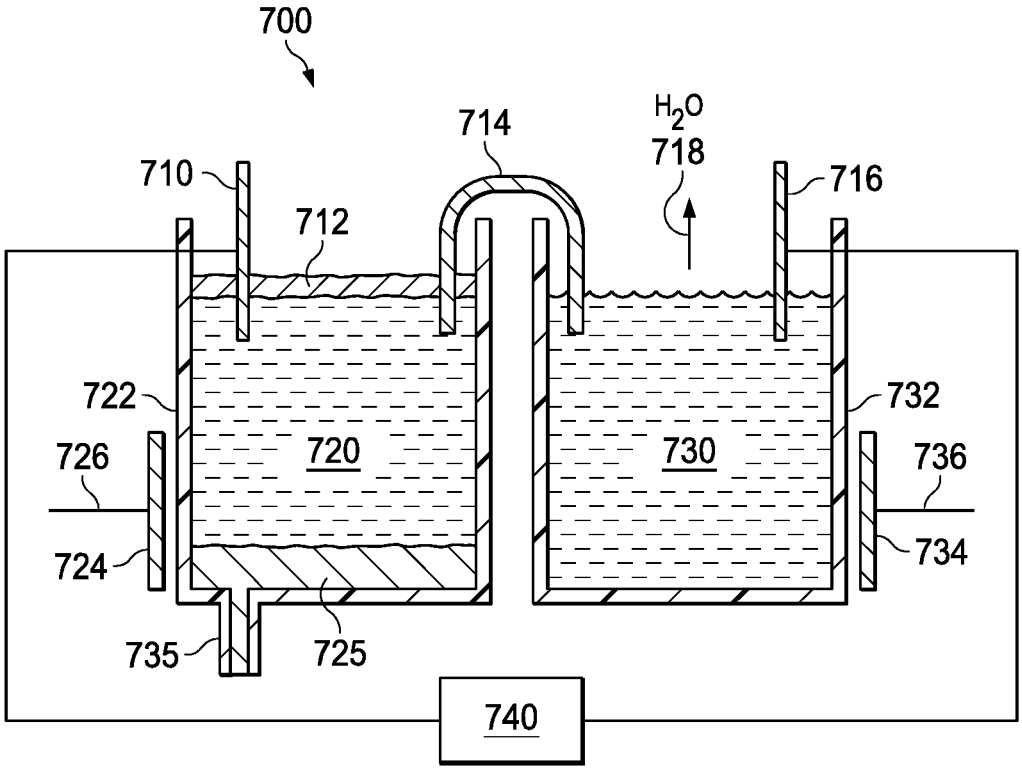
FIG. 7 is a block diagram illustrating selected elements of a multi-state electrolytic cell system for a high-temperature aluminum production process, in accordance with some embodiments of the present disclosure.

In some embodiments, a multi-state electrolytic cell may be configured to extract a metal, such as aluminum, as a product of interest using electrolysis of a molten salt. FIG. 7 is a block diagram illustrating selected elements of a multi-state electrolytic cell system 700 for a high-temperature aluminum production process, in accordance with some embodiments.

In the illustrated embodiment, multi-state electrolytic cell system 700 includes a cathode 710 and an anode 716. In some embodiments, one or both of these electrodes may be made of steel. The multi-state electrolytic cell system 700 includes an electrolyte tank 722 on the cathode side containing a molten electrolyte 720. In this example, the molten electrolyte 720 may be or include an aluminum oxide in cryolite, or $Na_3AlF_6$. The multi-state electrolytic cell system 700 also includes an electrolyte tank 732 on the anode side containing an electrolyte 730. In some embodiments, the electrolyte 730 may be or include sodium iodide, sodium chloride, or another sodium halide compound.

As illustrated in FIG. 7, the multi-state electrolytic cell system 700 may include a salt bridge 714 that serves as an ionic pathway between the electrolytes 720 and 730 in tanks 722 and 732, respectively. Multi-state electrolytic cell system 700 may also include a variable controllable power circuit 740 configured to apply a particular potential across the electrodes in order to switch between production states or between a production state and an idle state. When the multi-state electrolytic cell system 700 is operating in a production state associated with a first non-zero potential difference across the electrodes, it may operate under a predefined set of production process conditions. For example, heater circuits 724 and 734 may be activated or deactivated, as needed, by control signals 726 and 736, respectively, to maintain the temperature of multi-state electrolytic cell system 700 within a temperature range defined as part of the predefined set of production process conditions while the cell is operating in the production state. One or both of the heater circuits 724 and 734 may be or include combination heating/cooling elements, in various embodiments. Other corrective elements for maintaining the predefined set of production process conditions may be present in multi-state electrolytic cell system 700 (not shown) and may be activated, deactivated, or adjusted, as needed, while the cell is operating in the production state. When operating in a production state, the cell produces molten aluminum 725, which collects at the bottom of tank 722, and water 718 as products of interest that are output from the multi-state electrolytic cell system 700.

In the illustrated example, multi-state electrolytic cell system 700 includes an output port 735 through which molten aluminum 725 can be siphoned off as a product of interest for commercial distribution. The molten salt electrochemical process that produces molten aluminum 725 also produces slag 712 near the top of tank 722. When the multi-state electrolytic cell system 700 is operating in an idle state associated with a second, lower, non-zero potential difference, no products of interest are produced, although the predefined set of production process conditions is maintained. For example, heater circuits 724 and 734 may be activated or deactivated, as needed, by control signals 726 and 736, respectively, to maintain the temperature of multi-state electrolytic cell system 700 within a temperature range defined as part of the predefined set of production process conditions while the cell is operating in the idle state. Other corrective elements for maintaining the predefined set of production process conditions may be present in multi-state electrolytic cell system 700 (not shown) and may be activated, deactivated, or adjusted, as needed, while the cell is operating in the idle state.

Figure 8:
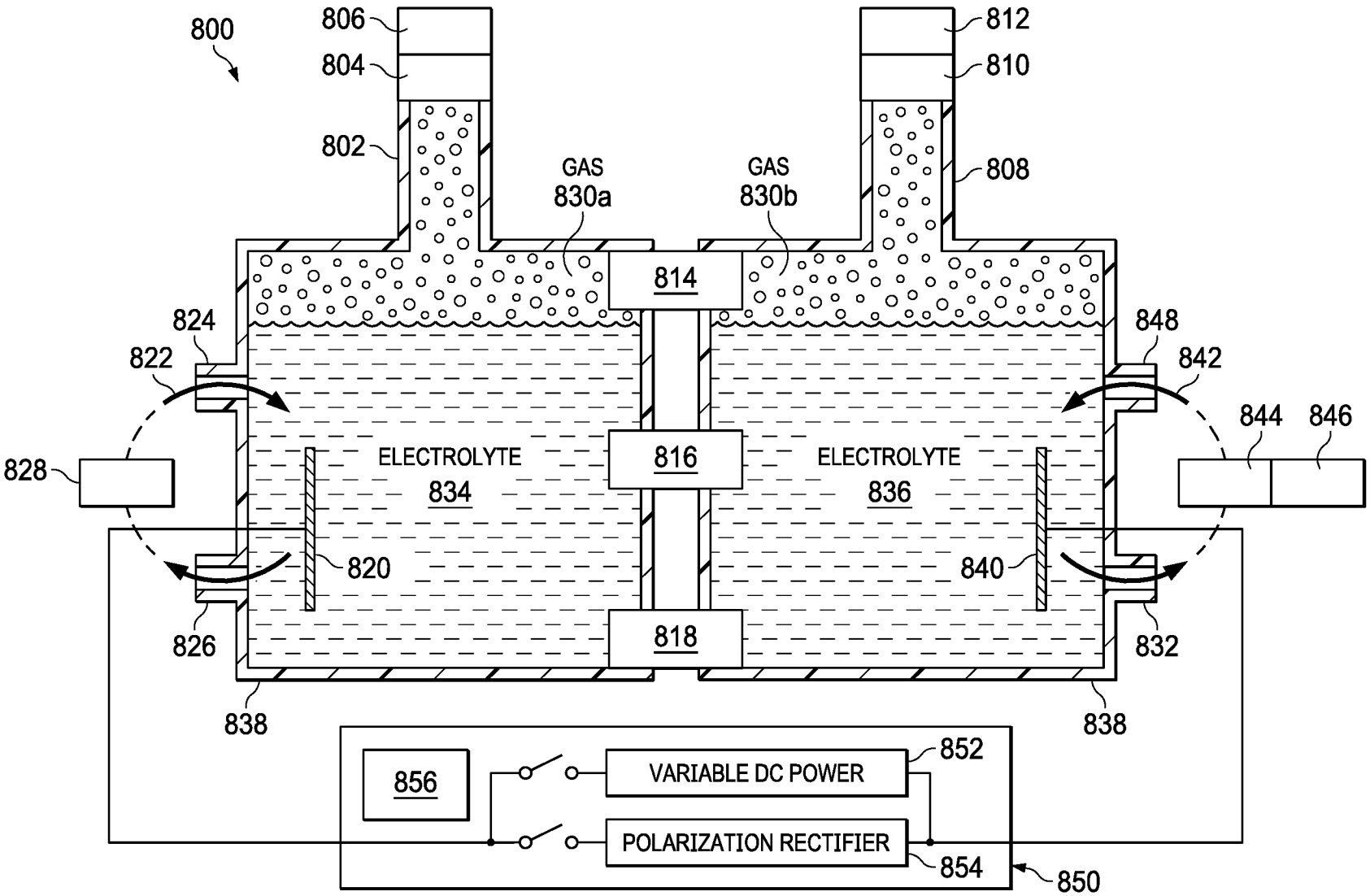
FIG. 8 is a block diagram illustrating selected elements of a multi-state electrolytic cell system, in accordance with some embodiments of the present disclosure.

In various embodiments, any or all of the multi-state electrolytic cells described herein may include one or more real-time monitoring and control subsystems for maintaining a predefined set of production process conditions. FIG. 8 is a block diagram illustrating selected elements of a multi-state electrolytic cell system 800 including multiple real-time monitoring and control subsystems for maintaining a predefined set of production process parameters when the multi-state electrolytic cells in these systems are operating in a production state associated with a first non-zero potential difference across the electrodes, or a first range of non-zero potential differences, and when they are operating in an idle state associated with a second non-zero potential difference across the electrodes, or a second range of non-zero potential difference, in which no products of interest are produced.

In the illustrated embodiment, multi-state electrolytic cell system 800 includes an anode 820 and a cathode 840. Multi-state electrolytic cell system 800 also includes an electrolyte tank 838 on the anode side containing electrolyte 834 and an electrolyte tank 858 on the cathode side containing electrolyte 836. In some embodiments, electrolyte tank 838 and electrolyte tank 858 may represent portions of a single tank on the anode and cathode side of an ionic pathway, respectively. As illustrated in FIG. 8, multi-state electrolytic cell system 800 may include one or more ionic pathways 814, 816, or 818 between electrolytes 834 and 836. For example, each of the ionic pathways 814, 816, or 818 may be or include a membrane, a salt bridge, a glass tube, or another type of ionically conductive pathway, in any combination.

In the illustrated embodiment, multi-state electrolytic cell system 800 includes output portals 802 and 808 for outputting products of the electrochemical process performed by the multi-state electrolytic cell system 800. Multi-state electrolytic cell system 800 also includes output portals 826 and 832 for recycling resources used or produced by the electrochemical process, and input portals 824 and 848 for the reintroduction of recycled resources into the system. Also shown in FIG. 8 are head gases 830*a* and 830*b* on top of electrolytes 834 and 836, respectively. In some embodiments, head gas 830*a* may be produced as a result of an oxidation portion of an electrochemical process, and head gas 830*b* may be produced as a result of a corresponding reduction portion of the electrochemical process.

As illustrated in FIG. 8 multi-state electrolytic cell system 800 may include a variable controllable power circuit 850, including a variable DC power source 852, a polarization rectifier 854, and a power circuit controller 856, for selectively applying a suitable potential difference across the electrodes when the cell is in a particular production state or the idle state. For example, a non-zero potential difference associated with a production state may be applied across the electrodes by the variable controllable power circuit 850 to initiate production of a product of interest under a predefined set of production process conditions. In another example, a non-zero potential difference associated with an idle state may be applied across the electrodes by the variable controllable power circuit 850 to curtail production of the product of interest while maintaining the predefined set of production process conditions. In some embodiments, the variable DC power source 852 and polarization rectifier 854 may be controlled by the power circuit controller 856 to apply a suitable potential difference across the electrodes in order to initiate operation of the multi-state electrolytic cell system 800 in a particular production state or in the idle state. In some embodiments, the variable controllable power circuit 850 may be able to dynamically react to changes in the availability or price of electrical power supplied by an electrical grid, such as electrical grid 130 illustrated in FIG. 1, or electrical power supplied directly or indirectly by a non-schedulable power source, such as non-schedulable power source 120 illustrated in FIG. 1. For example, the power circuit controller 856 of the variable controllable power circuit 850 may be able to cause excess power to be bled off or returned to the electrical grid, while applying a potential difference across the electrodes that is suitable for production of the product or products of interest. Conversely, the power circuit controller 856 of the variable controllable power circuit 850 may be configured to prevent the potential difference across the electrodes from dropping all the way to zero when the electrical power supplied by the electrical grid or a non-schedulable power source drops below the cut-in voltage for the multi-state electrolytic cell 858 using, for example, polarization rectifier 854.

In the example embodiment illustrated in FIG. 8, output portals 802 and 808 include respective monitoring and control subsystems 806 and 810 for maintaining a predefined set of production process conditions, such as for maintaining an appropriate head gas back pressure or for pH balancing. In some embodiments, the monitoring and control subsystems 806 and 810 may include sensors or other measurement devices inside the output portals in which they reside that provide data indicating the current conditions within the multi-state electrolytic cell system 800. In other embodiments, the monitoring and control subsystems 806 and 810 may receive information from various sensors or other measurement devices elsewhere in the multi-state electrolytic cell system 800 indicating current conditions within the system.

If the conditions in the multi-state electrolytic cell system 800 are inconsistent with the predefined set of production process conditions, additional system elements may be activated by the monitoring and control subsystems 806 and 810 to place or return the system to the predefined set of production process conditions. For example, output portals 802 and 808 may include respective back pressure pumps 804 and 810 that are activated by the respective monitoring and control subsystem 806 or 810 if the head gas pressure on the anode or cathode side of the multi-state electrolytic cell falls below a predefined head gas pressure threshold to return it to a value consistent with the predefined set of production process conditions, such as defined allowable range of head gas pressure values.

As illustrated in FIG. 8, the multi-state electrolytic cell system 800 may include a monitoring and control subsystem 828 on a recirculation line on the anode side of the system, such as recirculation line 822, for maintaining a predefined set of production process conditions through active species concentration, purging, or other methods. If, based on monitoring the recycled resource in the recirculation line 822, it is determined that the active species concentration or another characteristic of the recycled resource is inconsistent with the predefined set of production process conditions, the monitoring and control subsystem 828 may initiate corrective action, such as the introduction of an additive, the dilution of an electrolytic solution, or the purging of an unwanted element to return the multi-state electrolytic cell system 800 to the predefined set of production process conditions. For example, the monitoring and control subsystem 828 may output a control signal to activate a purge element, such as 460 illustrated in FIG. 4B, to initiate the addition of acid, such as acid 404 illustrated in FIGS. 4A and 4B, to modify an input amount of an active species, or to introduce more or less of a recycled resource into the system.

In some embodiments, the multi-state electrolytic cell system 800 may include a monitoring and control subsystem 844 on a recirculation line on the cathode side of the system for controlling or maintaining production process conditions, such as temperature, active species concentration, ionic strength, or pH. For example, the monitoring and control subsystem 844 may receive measurement data from one or more temperature sensors, pH sensors, or other input/output devices indicative of the conditions in the multi-state electrolytic cell system 800. In addition to performing any or all of the monitoring and control functions described with respect to monitoring and control subsystem 828, monitoring and control subsystem 844 may activate one or more heating/cooling elements 846 to return the temperature of an input resource, a portion of the multi-state electrolytic cell system 800, or the multi-state electrolytic cell system 800 as a whole to a value within the allowable range specified for the production process conditions.

While particular monitoring and control subsystems and corrective elements are shown in specific locations within the multi-state electrolytic cell system 800 illustrated in FIG. 8, in other embodiments, more, fewer, or different monitoring and control subsystems and corrective elements may occur in different combinations and may reside in other locations within the multi-state electrolytic cell system. In some embodiments, a single, centralized monitoring and control subsystem may receive inputs from multiple distributed sensors or measurement devices and output control signals to various corrective elements to return the cell to the predefined set of production process conditions.

Real-time monitoring and control elements similar to those illustrated in FIG. 8 and described above may be implemented in other multi-state electrolytic cell systems including, but not limited to, those illustrated in FIGS. 2, 4A, 4B, 7, and 9, to maintain a predefined set of production process parameters when the multi-state electrolytic cells in these systems are operating in a production state associated with a first non-zero potential difference across the electrodes and when they are operating in an idle state associated with a second non-zero potential difference across the electrodes in which no products of interest are produced.

Figure 10:
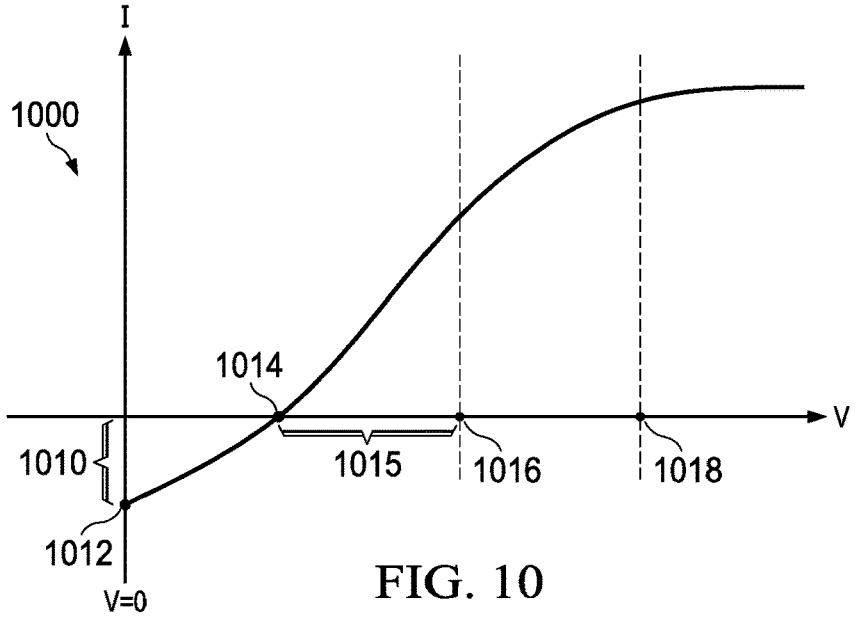
FIG. 10 illustrates a production curve for an electroplating process using a multi-state electrolytic cell, in accordance with some embodiments of the present disclosure.

Another type of electrochemical process that may be implemented using the multi-state electrolytic cells described herein is electroplating processes, such as a silver plating process. In some embodiments, an electroplating process may also benefit from an ability to maintain a predefined set of production process conditions while moving between production states or while moving between a production state and an idle state, as described herein. Electroplating processes may be described using a production curve that is somewhat different than the production curve illustrated in FIG. 3 and described above. An example production curve for an electroplating process is illustrated in FIG. 10 and described below.

Figure 9:
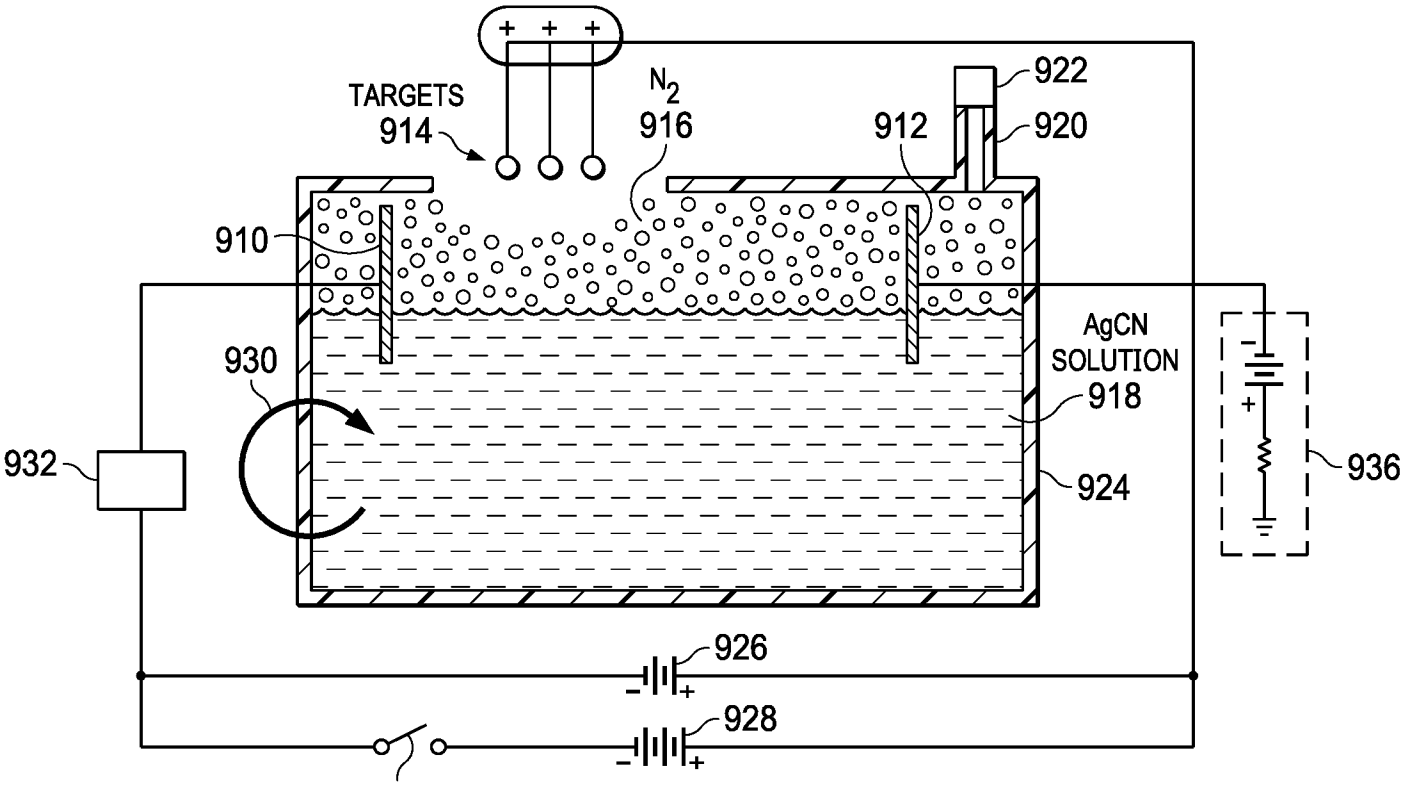
FIG. 9 is a block diagram illustrating selected elements of a multi-state electrolytic cell system 900 for an electroplating process, in accordance with some embodiments of the present disclosure.

FIG. 9 is a block diagram illustrating selected elements of a multi-state electrolytic cell system 900 for electroplating process, in accordance with some embodiments. More specifically, the multi-state electrolytic cell system 900 is configured for electroplating silver on multiple targets 914. In the illustrated embodiment, multi-state electrolytic cell system 900 includes an anode 910 and a cathode 912, which is coupled to a bleed circuit 936. The multi-state electrolytic cell system 900 also includes a single tank 924 containing a silver cyanide solution 918.

As illustrated in FIG. 9, the multi-state electrolytic cell system 900 may include a polarization rectifier 926, a variable controllable DC power source 928, and a switch 934 for selectively coupling the variable controllable DC power source to the electrodes to apply a particular potential difference across the anode and the cathode, as described herein. The potential difference applied across the electrodes may correspond to a production state in which electroplating takes place or an idle state in which electroplating does not take place. In some embodiments, there may be more than one production state in which electroplating with is possible with reasonable quality. When the multi-state electrolytic cell system 900 is operating in a production state and the targets 914 are lowered into the silver cyanide solution 918, the targets to be plated act as a third electrode in the multi-state electrolytic cell system 900, and the electroplating reaction is initiated.

In the illustrated embodiment, the multi-state electrolytic cell system 900 includes an output port 920 for outputting products of the electroplating process, such as nitrogen. The output port 920 may include a real-time monitoring and control subsystem 922 for maintaining a predefined set of production process conditions such as pressure on the head gases produced by the process, which in this case is shown as nitrogen 916, active species concentration, temperature, or other conditions.

Also shown in FIG. 9 is a recirculation mechanism 930 for recycling resources in the multi-state electrolytic cell system 900. In some embodiments, the multi-state electrolytic cell system 900 may include a real-time monitoring and control subsystem 932 for controlling or maintaining a predefined set of production process conditions, such as pressure, active species concentration, temperature, or other conditions.

In some embodiments, the ability to move from a production state to an idle state by controlling the potential difference across the electrodes of the multi-state electrolytic cell system 900 may allow the targets 914 of the electroplating operation to be cleaned or passivated before or between operations to deposit multiple layers of silver on the targets 914 while operating in an idle state. For example, before depositing a first layer, the potential difference associated with the idle state may be applied across the electrodes. While the cell is operating in the idle state, the targets may be cleaned. Subsequently, a potential difference associated with a production state may be applied across the electrodes. In this state, a first layer may be deposited on the targets 914. Following the deposition of the first layer, the potential difference associated with the idle state may again be applied across the electrodes. While the cell is operating in the idle state, the targets may be cleaned or passivated before a potential difference associated with the production state is again applied across the electrode in order to deposit a second layer, and so on.

FIG. 10 illustrates a production curve 1000 for an electroplating process using a multi-state electrolytic cell, in accordance with some embodiments. More specifically, production curve 1000 maps the current (i) flowing in the multi-state electrolytic cell to the corresponding potential difference (V) between the anode and the cathode of the multi-state electrolytic cell. Particular points along production curve represent respective states of the multi-state electrolytic cell. In FIG. 10, a current value labeled as 1012 the y-axis may represent a negative current when potential difference between the electrodes is zero. A voltage value labeled as 1016 may represent the half-cell potential, or $E_{1/2}$, corresponding to a cut-in voltage at which plating occurs but is of low quality. Point 1018 on production curve 1000 may represent a target production point for good quality plating.

In FIG. 10, point 1014 on production curve 1000 represents an idle state in which no product of interest is produced, and no plating takes place, although the process conditions under which the multi-state electrolytic cell operates in the idle state are the same as the predefined production process conditions under which the multi-state electrolytic cell operates in the production states. Also shown in FIG. 10 are an underpotential deposition region 1015 and a region of reverse current, shown as 1010.

Figure 11:
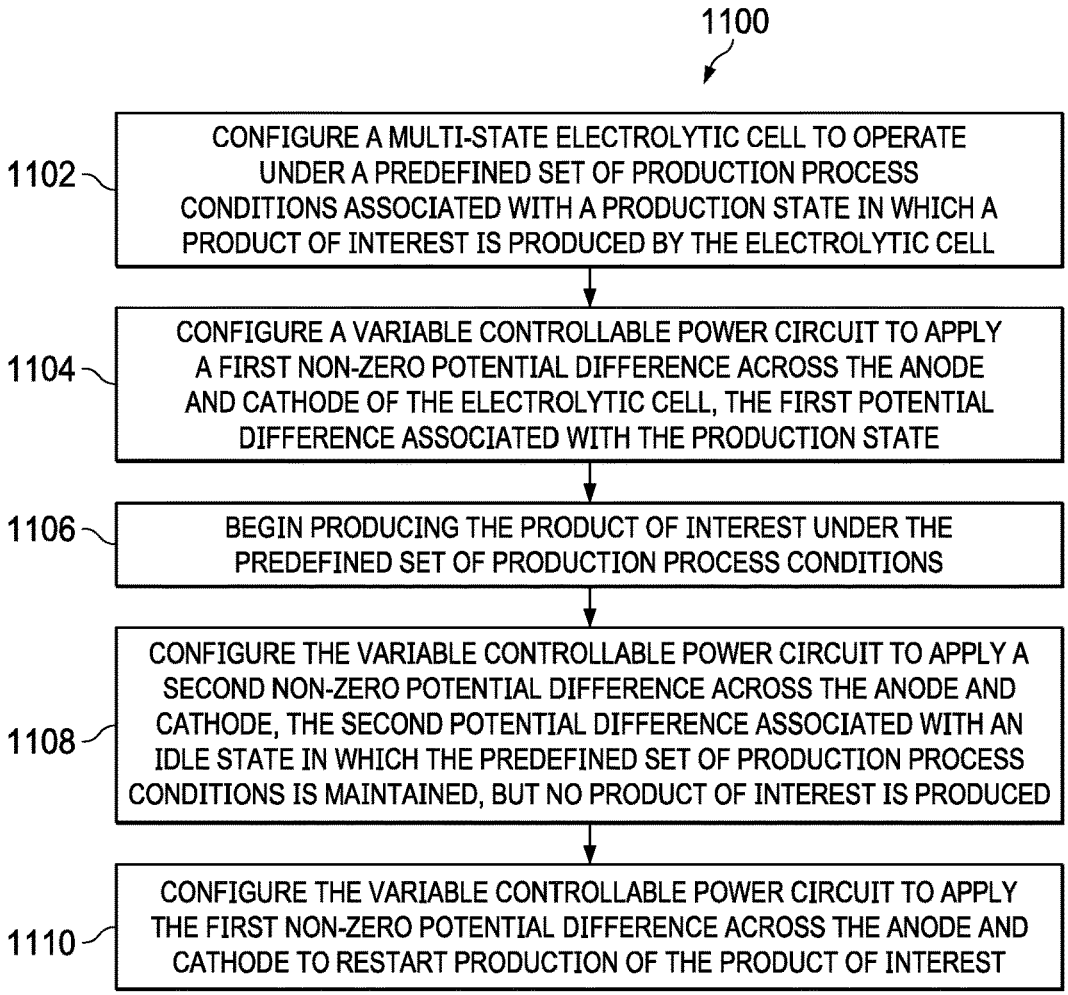
FIG. 11 is a flow diagram illustrating selected elements of a method for controlling an electrochemical process using a multi-state electrolytic cell, in accordance with some embodiments of the present disclosure.

FIG. 11 is a flow diagram illustrating selected elements of a method 1100 for controlling an electrochemical process using a multi-state electrolytic cell, in accordance with some embodiments.

At 1102, method 1100 includes configuring a multi-state electrolytic cell to operate under a predefined set of production process conditions associated with a production state in which a product of interest is produced by the multi-state electrolytic cell. For example, production process inputs including, but not limited to, an electrolyte solution including a concentration of an active species suitable for production, or various additives needed to achieve a pH suitable for production may be introduced into the multi-state electrolytic cell. In addition, one or more components such as a heating element, a cooling element, a back pressure pump, or a switch may be activated to cause the multi-state electrolytic cell to reach the predefined set of production process conditions.

At 1104, the method includes configuring a variable controllable power circuit to apply a first non-zero potential difference across the anode and cathode of the multi-state electrolytic cell, the first non-zero potential difference being associated with the production state. In one example, an operator may control the selection of an electrical power source or the ramping of the potential difference across the electrodes. In another example, the selection of an electrical power source or the ramping of the potential difference across the electrodes may be controlled automatically based on the availability of electrical power from various sources, some of which may be non-schedulable power sources, and the current conditions in the multi-state electrolytic cell system.

At 1106, method 1100 includes beginning production of the product of interest under the predefined set of production process conditions.

At 1108, the method includes, subsequent to beginning production of the product of interest, configuring the variable controllable power circuit to apply a second non-zero potential difference across the anode and cathode of the multi-state electrolytic cell, the second non-zero potential difference being associated with an idle state in which the predefined set of production process conditions are maintained in the multi-state electrolytic cell, but the product of interest is not produced. In some embodiments in which the multi-state electrolyte cell produces more than one product of interest when operating in a production state, none of the products of interest may be produced while in the idle state.

At 1110, subsequent to the multi-state electrolytic cell being placed in the idle state, method 1100 includes configuring the variable controllable power circuit to apply the first non-zero potential difference across the anode and cathode to restart production of the product or products of interest. In some embodiments, the operations shown in 1108 and 1110 may be repeated in an alternating fashion any number of times to respond to changes in the availability or price of electrical power or for other reasons.

Figure 12:
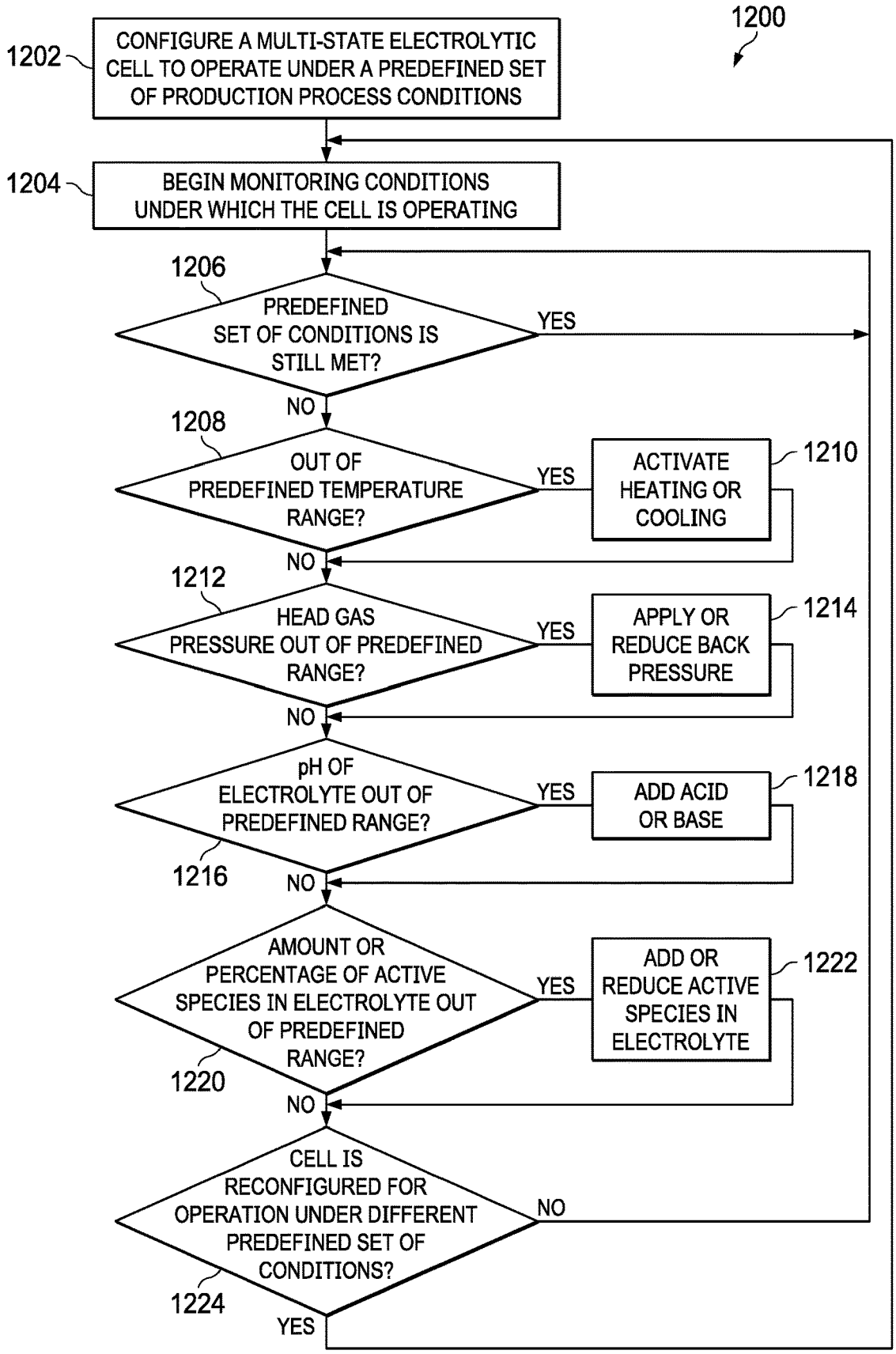
FIG. 12 is a flow diagram illustrating selected elements of a method for maintaining a set of production process conditions of a multi-state electrolytic cell, in accordance with some embodiments of the present disclosure.

FIG. 12 is a flow diagram illustrating selected elements of a method 1200 for maintaining a set of production process conditions of a multi-state electrolytic cell, in accordance with some embodiments. In various embodiments, each of the operations shown in FIG. 12 may be performed by a respective monitoring and control subsystem of the multi-state electrolytic cell. In some embodiments, multiple operations shown in FIG. 12 may be performed by a single monitoring and control subsystem, or all of the operations shown in FIG. 12 may be single central monitoring and control subsystem.

At 1202, method 1200 includes configuring a multi-state electrolytic cell to operate under a predefined set of production process conditions, as described above in reference to FIG. 11. At 1204, the method includes beginning to monitor the conditions under which the multi-state electrolytic cell is operating.

If, at 1206, it is determined that the multi-state electrolytic cell is no longer operating under the predefined set of production process conditions, method 1200 may proceed to 1208. Otherwise, method 1200 may return to 1206 until or unless the multi-state electrolytic cell is no longer operating under the predefined set of production process conditions.

If, at 1208, it is determined that the multi-state electrolytic cell is operating outside of a predefined allowable temperature range, such as a temperature range defined as part of the predefined set of production process conditions, the method may proceed to 1210. Otherwise, the method may continue at 1212.

At 1210, method 1200 includes activating a heating or cooling element to return the temperature of the multi-state electrolytic cell, or of a component thereof, to the predefined allowable temperature range. For example, the system may include a respective heating or cooling element per cell or per rack to heat or cool the cell, inputs to the cell, or elements of the system proximate the cell, in different embodiments.

If, at 1212, it is determined that the multi-state electrolytic cell is operating with a head gas pressure outside of a predefined allowable head gas pressure range, such as a head gas pressure range defined as part of the predefined set of production process conditions, the method may proceed to 1214. Otherwise, the method may continue at 1216.

At 1214, method 1200 includes applying or reducing the application of back pressure in a portion of the multi-state electrolytic cell. to return the head gas pressure to the predefined allowable head gas pressure range for that portion of the cell. For example, the method may include activating a back pressure pump, or turning valve to increase or decrease the head gas pressure in the affected portion of the cell.

If, at 1216, it is determined that the multi-state electrolytic cell is operating with a pH outside of a predefined allowable pH range, such as a pH range defined as part of the predefined set of production process conditions, the method may proceed to 1218. Otherwise, the method may continue at 1220.

At 1218, method 1200 includes introducing an acid or base into the multi-state electrolytic cell to return the pH to the predefined allowable pH range.

If, at 1220, it is determined that the multi-state electrolytic cell is operating with an amount or percentage of an active species in an electrolyte outside of a predefined allowable range, such as a range defined as part of the predefined set of production process conditions, the method may proceed to 1222. Otherwise, the method may continue at 1224.

At 1222, method 1200 includes initiating an addition or reduction in the amount or percentage of the active species in the electrolyte to return to the predefined allowable range. For example, fresh or recycled process resources or other additives may be introduced into the electrolyte at an input pipe or portal, or water or another substance may be added to the electrolyte to dilute the concentration of the active species.

If, at 1224, it is determined that the multi-state electrolytic cell is reconfigured for operation under a different predefined set of production process conditions, method 1200 may include returning to 1206 and repeating one or more of the operations shown as 1208 through 1224, as appropriate. Otherwise, method 1200 may return to 1204 and repeat one or more of the operations shown as 1206 through 1224, as appropriate. Note that the predefined set of production process conditions may specify acceptable values or ranges of values for conditions other than those illustrated in FIG. 12 or discussed herein. These additional conditions may also be monitored and may trigger corrective action when they are found to be outside the predefined production process conditions.

Figure 13:
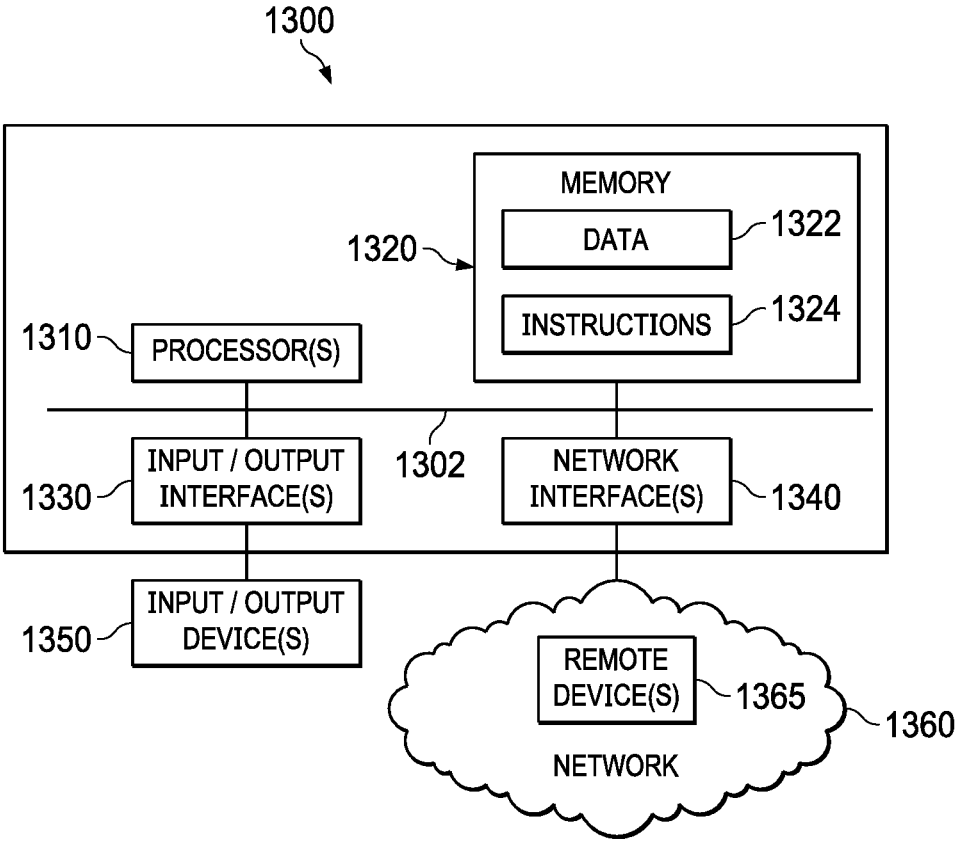
FIG. 13 is a block diagram illustrating selected elements of a real-time monitoring and control subsystem for a multi-state electrolytic cell, in accordance with some embodiments of the present disclosure.

FIG. 13 is a block diagram illustrating selected elements of a monitoring and control subsystem 1300 for a multi-state electrolytic cell system, in accordance with some embodiments. For example, monitoring and control subsystem 1300 may represent any of multiple ones of the monitoring and control subsystems described herein including monitoring and control subsystems 806, 810, 828 or 844 illustrated in FIG. 8, monitoring and control subsystems 922 or 932 illustrated in FIG. 9, or a monitoring and control subsystem associated with a variable controllable power circuit, such power circuit controller 856 illustrated in FIG. 8. In some embodiments, monitoring and control subsystem 1300 may be a real-time monitoring and control subsystem that responds in real time to changes in the conditions in a multi-state electrolytic cell system, or in any of the multi-state electrolytic cells thereof, and takes corrective action to return the system to a predefined set of production process conditions. In some embodiments, monitoring and control subsystem 1300 may be configured to control the selection of one of multiple available sources of electrical power or to control the potential difference applied across the electrodes of a multi-state electrolytic cell to initiate operation of the cell in a particular production state in which one or more products are produced or in an idle state in which no products are produced.

As illustrated in FIG. 13, monitoring and control subsystem 1300 may include one or more processors 1310, and a memory 1320, including data 1322 and instructions 1324 executable by the processors 1310. Monitoring and control subsystem 1300 may also include one or more input/output interfaces 1330 through which monitoring and control subsystem 1300 may communicate to exchange data, commands, or control signals various input/output devices 1350 to perform the methods described herein. The input/output devices may include, for example, any of a variety of sensors, keyboards or other user input devices, display, touch devices, switches, actuators, heating or cooling elements, back pressure pumps, or any other mechanical or electrical components of the system that provide inputs to are may be controlled by monitoring and control subsystem 1300 to control an electrochemical production process in a multi-state electrolytic cell. Monitoring and control subsystem 1300 may also include one or more network interfaces 1340 through which through which monitoring and control subsystem 1300 may communicate to exchange data, commands, or control signals with various remote devices 1365 in a network 1360 to perform the methods described herein. For example, in some embodiments, input or commands may be received by the monitoring and control subsystem 1300 from a remote system, such as a central control system for an electrochemical plant located outside the plant itself. The processors 1310, memory 1320, input/output interfaces 1330, and network interfaces 1340 may be coupled to each other over interconnect 1302.

In various embodiments, inputs may be provided to monitoring and control subsystem 1300 by an operator, an administrator, or another user using a keyboard and a mouse or using a touch device (not shown). In some embodiments, at least some of the operations of the monitoring and control subsystem 1300 may be fully automated. In some embodiments, at least some of the operations of the monitoring and control subsystem 1300 may be automated with options for an operator or administrator to override the automated features if necessary, such as for safety reasons or in response to unforeseen conditions in the multi-state electrolytic cell system.

Input/output interfaces 1330 may represent, for example, a variety of communication interfaces, graphics interfaces, video interfaces, user input interfaces, and/or peripheral interfaces. In some embodiments, an operator or administrator may define the production process conditions to be maintained in both production states and the idle state through a user interface, an operator or administrator may select the potential difference to be applied across the electrodes of the multi-state electrolytic cell to place the multi-state electrolytic cell in a particular production state or in the idle state. In some embodiments, monitoring and control subsystem 1300 may be configured to automatically receive, though input/output interfaces 1330, data from various sensors indicating the current conditions of the multi-state electrolytic cell, to detect a change in the current conditions or a change in the availability of received electrical power and to determine when and whether to change the potential difference across the electrodes or to activate a corrective element to return to the cell to a predefined set of production process conditions. For example, in response to determining that the potential difference across the electrodes should be changed to place the cell in a different state or that a corrective element should be activated to return to the cell to the predefined set of production process conditions, the monitoring and control subsystem 1300 may be configured to transmit a control signal to a back pressure pump, an actuator, a switch, a heating or cooling element, or any other mechanical or electrical components of the system to effect the determined change.

Interconnect 1302 may represent a variety of suitable types of bus structures, e.g., a memory bus, a peripheral bus, or a local bus using various bus architectures in selected embodiments. For example, such architectures may include, but are not limited to, Micro Channel Architecture (MCA) bus, Industry Standard Architecture (ISA) bus, Enhanced ISA (EISA) bus, Peripheral Component Interconnect (PCI) bus, PCI-Express bus, HyperTransport (HT) bus, and Video Electronics Standards Association (VESA) local bus.

In FIG. 13, a network interface 1340 may be a suitable system, apparatus, or device operable to serve as an interface between monitoring and control subsystem 1300 and a network 1360. Network interface 1340 may enable monitoring and control subsystem 1300 to communicate over the network using a suitable transmission protocol and/or standard, including, but not limited to, transmission protocols and/or standards, in different embodiments. In some embodiments, network interface 1340 may be communicatively coupled via the network 1360 to various remote devices 1365. Network 1360 may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, the Internet or another appropriate architecture or system that facilitates the communication of signals, data and/or messages (generally referred to as data). Network 1360 may transmit data using a desired storage and/or communication protocol, including, but not limited to, Fibre Channel, Frame Relay, Asynchronous Transfer Mode (ATM), Internet protocol (IP), other packet-based protocol, small computer system interface (SCSI), Internet SCSI (iSCSI), Serial Attached SCSI (SAS) or another transport that operates with the SCSI protocol, advanced technology attachment (ATA), serial ATA (SATA), advanced technology attachment packet interface (ATAPI), serial storage architecture (SSA), integrated drive electronics (IDE), and/or any combination thereof. Network 1360 and/or various components associated therewith may be implemented using hardware, software, or any combination thereof.

As depicted in FIG. 13, a processor 1310 may comprise a system, device, or apparatus operable to interpret and/or execute program instructions and/or process data, and may include a microprocessor, microcontroller, digital signal processor (DSP), application specific integrated circuit (ASIC), or another digital or analog circuitry configured to interpret and/or execute program instructions and/or process data. In some embodiments, processor 1310 may interpret and/or execute program instructions and/or process data stored locally (e.g., in memory 1320). In some embodiments, processor 1310 may interpret and/or execute program instructions and/or process data stored remotely (e.g., in a network storage resource on network 1360, not shown).

Memory 1320 may comprise a system, device, or apparatus operable to retain and/or retrieve program instructions and/or data for a period of time (e.g., computer-readable media). Memory 1320 may comprise random access memory (RAM), electrically erasable programmable read-only memory (EEPROM), a PCMCIA card, flash memory, magnetic storage, opto-magnetic storage, a hard disk drive, a floppy disk drive, a CD-ROM or other type of rotating storage media or solid state storage media, or a suitable selection or array of volatile or non-volatile memory that retains data after power to monitoring and control subsystem 1300 is powered down.

In various embodiments, any particular instance of monitoring and control subsystem 1300 may include more, fewer, or different components than those illustrated in FIG. 13, as appropriate for the context in which the instance of monitoring and control subsystem 1300 is operating.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A system, comprising:

a variable controllable power circuit;

an electrolytic cell coupled to the variable controllable power circuit and comprising an anode and a cathode, the electrolytic cell configured to operate in different ones of multiple operating states at respective different times dependent on a potential difference between the anode and the cathode;

a power circuit controller that causes the variable controllable power circuit to apply a given potential difference across the anode and the cathode to initiate operation of the electrolytic cell in a particular one of the multiple operating states associated with the given potential difference, the multiple operating states comprising:

a production state associated with a first non-zero potential difference in which a product of interest is produced by the electrolytic cell; and an idle state associated with a second non-zero potential difference that is insufficient to support production of the product of interest by the electrolytic cell; and a monitoring and control subsystem configured to maintain a predefined set of production process conditions for the electrolytic cell while the electrolytic cell is operating in the production state and while the electrolytic cell is operating in the idle state, the predefined set of production process conditions comprising a predefined operating temperature range;

wherein the product of interest is chlorine.

2. The system of claim 1, wherein the electrolytic cell comprises two or more tanks, each comprising a feedstock for an electrochemical process, and an ionic conduction path between the tanks.

3. The system of claim 1, wherein:

the electrolytic cell is one of a plurality of multi-state electrolytic cells each comprising a respective anode and a respective cathode; and potential differences across the anodes and cathodes in the multi-state electrolytic cells are collectively controllable.

4. The system of claim 1, wherein:

the electrolytic cell is one of a plurality of multi-state electrolytic cells each comprising a respective anode and a respective cathode; and respective potential differences across the anodes and cathodes in each of the multi-state electrolytic cells are individually controllable.

5. The system of claim 1, wherein the variable power control circuit is configured to receive power from a non-schedulable power source.

6. The system of claim 1, wherein the variable power control circuit is controllable to select a power source for applying the given potential difference across the anode and the cathode from among two or more power sources.

7. The system of claim 1, wherein the monitoring and control subsystem is configured to receive data from a sensor representing a measurement of a current condition in the electrolytic cell.

8. The system of claim 1, wherein the electrolytic cell comprises a recirculation loop through which an output of the electrochemical process is returned to the electrolytic cell as an input.

9. The system of claim 1, wherein the electrolytic cell is configured to produce a second product of interest while the electrolytic cell operates in the production state.

10. The system of claim 1, wherein:

the production state is one of a plurality of production states in which the electrolytic cell is configured to operate; and at least one of the rate at which the electrolytic cell produces the product of interest and the rate at which the electrolytic cell consumes input resources is dependent on the one of the production states in which the electrolytic cell is operating.

11. The system of claim 1, wherein the production state is one of a plurality of production states in which the electrolytic cell is configured to operate;

the electrolytic cell is configured to produce a plurality of products of interest; and the relative amounts of the plurality of products of interest produced by the electrolytic cell is dependent on the one of the production states in which the electrolytic cell is operating.

12. The system of claim 1, wherein the predefined set of production process conditions further comprises at least one of:

a predefined pressure range for back pressure on a head gas within the electrolytic cell; and a predefined concentration range for concentration of an active species within a feedstock of the electrolytic cell.

13. A method, comprising:

configuring a variable controllable power circuit to apply a first non-zero potential difference across an anode and a cathode of an electrolytic cell to initiate operation of the electrolytic cell in a production state associated with the first non-zero potential difference in which a product of interest is produced by the electrolytic cell;

operating the electrolytic cell in the production state to produce the product of interest;

while operating the electrolytic cell in the production state, configuring the variable controllable power circuit to apply a second non-zero potential difference across the anode and the cathode of the electrolytic cell to initiate operation of the electrolytic cell in an idle state associated with the second non-zero potential difference, the second non-zero potential difference being insufficient to support production of the product of interest by the electrolytic cell; and while operating the electrolytic cell in the idle state, configuring the variable controllable power circuit to reapply the first non-zero potential difference across the anode and the cathode of the electrolytic cell to return the electrolytic cell to the production state;

wherein the product of interest is chlorine.

14. The method of claim 13, further comprising, prior to application of the first non-zero potential difference across the anode and the cathode of the electrolytic cell, configuring the electrolytic cell to operate under a predefined set of production process conditions comprising a predefined operating temperature range.

15. The method of claim 14, further comprising, maintaining the predefined set of production process conditions while the electrolytic cell is operating in the production state; and maintaining the predefined set of production process conditions while the electrolytic cell is operating in the idle state.

16. The method of claim 15, wherein maintaining the predefined set of production process conditions comprises activating a heating or cooling element to return a temperature of the electrolytic cell to a value within the predefined operating temperature range in response to receiving an indication that the temperature is outside the predefined operating temperature range.

17. The method of claim 15, wherein maintaining the predefined set of production process conditions comprises applying or reducing back pressure on a head gas within the electrolytic cell to return the back pressure on the head gas to a value within a predefined pressure range in response to receiving an indication that the back pressure on the head gas is outside the predefined pressure range.

18. The method of claim 15, wherein maintaining the predefined set of production process conditions comprises increasing or reducing a concentration of an active species within a feedstock of the electrolytic cell to return the concentration of the active species within the feedstock to a value within a predefined concentration range in response to receiving an indication that the concentration of the active species within the feedstock is outside the predefined concentration range.

19. The method of claim 13 wherein:

the electrolytic cell is one of a plurality of multi-state electrolytic cells each comprising a respective anode and a respective cathode; and configuring the variable controllable power circuit to apply the first non-zero potential difference across the anode and the cathode of the electrolytic cell comprises collectively controlling respective potential differences across the anodes and cathodes of each of the plurality of multi-state electrolytic cells.

20. The method of claim 13, wherein:

the electrolytic cell is one of a plurality of multi-state electrolytic cells each comprising a respective anode and a respective cathode; and configuring the variable controllable power circuit to apply the first non-zero potential difference across the anode and the cathode of the electrolytic cell comprises individually controlling respective potential differences across the anodes and cathodes of each of the plurality of multi-state electrolytic cells.

* * * * *